US006878027B1

(12) United States Patent
Kawasaki

(10) Patent No.: US 6,878,027 B1
(45) Date of Patent: Apr. 12, 2005

(54) METHOD FOR PRODUCING ELECTRON SOURCE, ELECTRON SOURCE PRODUCED THEREBY, METHOD FOR PRODUCING IMAGE FORMING APPARATUS AND IMAGE FORMING APPARATUS PRODUCED THEREBY

(75) Inventor: Hideshi Kawasaki, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/512,360

(22) Filed: Feb. 24, 2000

(30) Foreign Application Priority Data

Feb. 24, 1999 (JP) ..... 11-045672
Feb. 18, 2000 (JP) ..... 2000-040390

(51) Int. Cl.[7] ..... H01J 9/00; H01J 9/02
(52) U.S. Cl. ..... 445/6; 445/24; 315/169.3
(58) Field of Search ..... 315/169.1, 169.2, 315/169.3; 445/6, 24

(56) References Cited

U.S. PATENT DOCUMENTS

| | | | | |
|---|---|---|---|---|
| 4,849,674 A | * | 7/1989 | Cherry et al. | 445/6 |
| 6,053,791 A | | 4/2000 | Fuji et al. | 445/6 |
| 6,534,924 B1 | | 3/2003 | Oguchi et al. | 315/169.1 |

FOREIGN PATENT DOCUMENTS

| | | | | |
|---|---|---|---|---|
| EP | 726591 A1 | * | 8/1996 | |
| EP | 729168 A2 | * | 8/1996 | |
| EP | 954005 A2 | * | 3/1999 | |
| JP | 0 660 357 A1 | | 6/1995 | |
| JP | 7-235255 | | 9/1995 | |
| JP | 7-307291 | | 5/1997 | |
| JP | 9-134666 | | 5/1997 | |
| JP | 3087849 | | 7/2000 | G03G/15/00 |
| JP | 3088102 | | 7/2000 | G11B/5/02 |

OTHER PUBLICATIONS

C.A. Spindt et al., "Physical Properties of Thin Films of Thin–film Field Emission Cathodes with Molybdenum Cones", J. Applied Physics, vol. 47, No. 12, Dec. 1976, pp. 5248–5263.

C.A. Mead, "Operation of Tunnel–Emission Devices," J. Applied Physics, vol. 32, No. 4, Apr. 1961, pp. 646–652.

W.P. Dyke et al., "Field Emission", Advances in Electronics and Electron Physics, vol. VIII, 1956, pp. 89–185.

M. Elinson, et al. "The Emission of Hot Electrons and the Field Emissions of Electrons From Tin Oxide", Radio Engineering and Electronic Physics, Jul. 1965, pp. 1290–1296.

G. Dittmer, "Electrical Conduction and Electron Emission of Discontinuous Thin Films", Thin Solid Films, 9, 1972 pp. 317–328.

M. Hartwell et al., "Strong Electron Emission From Patterned Tin–Indium Oxide Films", IEDM, 1975, pp. 519–521.

H. Araki, et al., "Electroforming and Electron Emission of Carbon Thin Films", Journal of the Vacuum Soc. of Japan, vol. 2–6, No. 1, 1983, pp. 22–29 (with English Abstract on p. 22).

* cited by examiner

*Primary Examiner*—Mariceli Santiago
(74) *Attorney, Agent, or Firm*—Fitzpatrick, Cella, Harper & Scinto

(57) ABSTRACT

A method for producing an electron source in which plural electron emission devices are connected in a matrix by plural row wirings and plural column wirings, the row wirings of a number m(=a×b×c) are divided into groups $G_1$ to $G_a$ of a number a, and the row wirings in each group are divided into sub groups $SG_1$ to $SG_b$ of a number b, each containing the row wirings of a number c. The deposition process is executed by voltage application by selecting the row wirings of $SG_1$ in succession and commonly to all the groups, and such deposition process is thereafter similarly executed on the sub groups starting from $SG_2$, whereby the deposition process for all the elements is executed by executing the deposition process for each sub group by b times.

7 Claims, 17 Drawing Sheets

$m = a \times b \times c$ $S_1 : D_{yd},\ D_{ydc+d},\ \cdots,\ D_{y(a-1)bc+d}$ $S_2 : D_{yb+d},\ D_{ybc+b+d},\ \cdots,\ D_{y(a-1)bc+b+d}$ $\vdots$ $S_{c-1} : D_{y(c-2)b+d},\ D_{y(c-2)b+bc+d},\ \cdots,\ D_{y(c-2)b+(a-1)bc+d}$ $S_c : D_{y(c-1)b+d},\ D_{y(c-1)b+bc+d},\ \cdots,\ D_{y(c-1)b+(a-1)bc+d}$ (d IS A NATURAL NUMBER OF 1~b)

$m = a \times b \times c$ $S_1 : D_{yd},\ D_{yd+d},\ \cdots,\ D_{y(a-1)b+d}$ $S_2 : D_{yab+d},\ D_{yb+a+d},\ \cdots,\ D_{y(a-1)b+ab+d}$ $\vdots$ $S_{c-1} : D_{y(c-2)ab+d},\ D_{y(c-2)ab+b+d},\ \cdots,\ D_{y(c-2)ab+(a-1)b+d}$ $S_c : D_{y(c-1)ab+d},\ D_{y(c-1)ab+b+d},\ \cdots,\ D_{y(c-1)ab+(a-1)b+d}$ (d IS NATURAL NUMBER OF 1~b)

$m = e \times a \times b \times c$ $S_1 : D_{yd},\ D_{yb+d},\ \cdots,\ D_{y(a-1)b+d}$ $S_2 : D_{yab+d},\ D_{yb+ab+d},\ \cdots,\ D_{y(a-1)b+ab+d}$ $\vdots$ $S_{c-1} : D_{y(c-2)ab+d},\ D_{y(c-2)ab+b+d},\ \cdots,\ D_{y(c-2)ab+(a-1)b+d}$ $S_c : D_{y(c-1)ab+d},\ D_{y(-1)ab+b+d},\ \cdots,\ D_{y(c-1)ab+(a-1)b+d}$ (d IS AN INTEGER OF $1 \sim b,\ abc+1 \sim acb+f,\ \cdots,\ acb(e-1)+1 \sim acb(e-1)+n$)

METHOD FOR PRODUCING ELECTRON SOURCE, ELECTRON SOURCE PRODUCED THEREBY, METHOD FOR PRODUCING IMAGE FORMING APPARATUS AND IMAGE FORMING APPARATUS PRODUCED THEREBY

BACKGROUND OF THE INVENTION

1. Field of the Invention

The present invention relates to a method for producing an electron source, an electron source produced by such method, a method for producing an image forming apparatus and an image forming apparatus produced by such method.

2. Related Background Art

The conventional electron emission devices are classified into a hot electron emission device and a cold cathode electron emission device. The cold cathode electron emission device includes a field emission type (hereinafter called "FE type"), a metal/insulating layer/metal type (hereinafter called "MIM" type) and a surface conduction electron emission device.

The FE type element has been disclosed for example by W. P. Dyke and W. W. Dolan, "Field Emission", Advance in Electron Physics, 8, 89(1956) and C. A. Spindt, "Physical properties of thin-film field emission cathodes with molybdenum cones", J. Appl. Phys., 47, 5248(1976).

Also the MIM type element has been disclosed for example by C. A. Mead, "Operation of tunnel-emission devices", J. Appl. Phys., 32, 646(1961).

Also the surface conduction electron emission device is disclosed for example by M. I. Elinson, Radio Eng. Electron Phys., 10, 1290(1965).

The surface conduction electron emission device utilizes a phenomenon of inducing electron emission by giving a current, on a thin film of a small area formed on an insulating substrate, parallel to the film. The surface conduction electron emission device has been reported in various structures such as a structure with a $SnO_2$ film reported by Elinson mentioned above, one with Au film (G. Dittmer, Thin Solid Films, 9, 317(1972), one with $In_2O_3$/SnO, film (M. Hartwell and C. G. Fonstad, IEEE Trans. ED Conf., 519(1957), and one with carbon film (H. Araki et al., Shinku (Vacuum), 26, No. 1, 22(1983).

As a typical example of the surface conduction electron emission devices, the configuration of the above-mentioned device by M. Hartwell is schematically shown in FIG. 16, wherein shown are a substrate 1901, a conductive film 1904 consisting for example of a metal oxide film formed by sputtering in an H-shaped pattern, and an electron emission part 1905 formed by a current passing process, called electroforming to be explained later. In the drawing, the element distance L is selected as 0.5 to 1 mm, and W' is selected as 0.1 mm.

In such electron conduction electron emission device, the electron emitting portion 1905 is generally formed, prior to the electron emission, by subjecting the conductive film 1904 to a current passing treatment which is called electroforming. More specifically, the electroforming is a process of applying, across the conductive film 1904, a DC voltage or a very slowing increasing voltage for example at a rate of 1 V/min, thereby causing local destruction, deformation or denaturing of the conductive film 1904 with a structure change therein, thus forming the electron emitting portion 1905 of a high electrical resistance. In the electron emitting portion 1905, cracks are formed in a part of the conductive film 1904 and the electron emission takes place from the vicinity of such cracks.

The surface conduction electron emission device subjected to the above-mentioned electroforming is capable of emitting electrons from the electron emitting portion 1905 by a current passing in the element under a voltage application thereto. Also the present application proposes a deposition process of significantly varying the current in the above-mentioned conductive film 1904 (hereinafter called "device current") and the current emitting in vacuum space (hereinafter called "electron emission current") (Japanese Patent Application Laid-open No. 7-235255).

Such surface conduction electron emission device, being simple in configuration, has an advantage that there can be easily prepared an electron source consisting of an array of a plurality of elements over a large area. Such feature is being investigated in various applications, such as use in an image forming apparatus such as a light-emitting thin image display apparatus.

With respect to the electron emitting characteristics, a further improvement in uniformity is being desired in order that the image forming apparatus utilizing such electron emission device can stably provide a bright displayed image. The efficiency of such element can be represented by the ratio of the device current and the electron emission current, and there is being desired an electron emission device with a smaller device current and a larger emission current. If the multiple electron emission devices constituting an electron source can be made uniform in the electron emitting characteristics, there can be realized an image forming apparatus utilizing a fluorescent material as the image forming member, for example a flat television unit, of a higher brightness and higher quality.

The present inventors have conducted research on the electron source consisting of an array of multiple surface conduction electron emission devices and the image forming apparatus utilizing such electron source, including the electron source based on the electrical wiring method shown in FIG. 5.

More specifically, the electron source is constituted by arranging a plurality of surface conduction electron emission devices in two-dimensional manner and wiring these elements in a matrix manner as illustrated. In FIG. 5 there are shown surface conduction electron emission devices 504 represented in schematic manner, row wirings 502 and column wirings 503. The wiring method shown in FIG. 5 is called simple matrix wiring.

In the electron source constituted by simple matrix wiring of multiple surface conduction electron emission devices as shown in FIG. 5, suitable electrical signals are applied to the row wiring 502 and the column wiring 503 in order to output a desired electron beam. For example, for driving the surface conduction electron emission devices of an arbitrary row in the matrix, a selection voltage $V_s$ is applied to the row wiring 502 of a selected row while a voltage $V_{ns}$ is applied to the row wirings 502 of the non-selected rows. In synchronization, a drive voltage $V_e$ for outputting the electron beam is applied to the column wiring 503.

In this method, if the voltage drop resulting from the resistance in the wirings is disregarded, the surface conduction electron emission devices of the selected row receive a voltage $V_e-V_s$, while those of the non-selected row receive a voltage $V_e-V_{ns}$, and the suitable selection of $V_e$, $V_s$ and $V_{ns}$ should cause emission of the electron beam of a desired intensity from the surface conduction electron emission devices of the selected row only while the application of respectively different drive voltages $V_e$ to the column wirings should cause emission of the electron beams of different intensities from the respective elements of the selected row.

Also, as the surface conduction electron emission device has a high response speed, the duration of electron beam output should be varied by varying the duration of application of the drive voltage $V_e$. Consequently, the electron source consisting of simple matrix wiring of multiple surface conduction electron emission devices has possibility of various applications, and can be advantageously utilized as the electron source for the image display apparatus under the application of suitable electrical signals corresponding to the image information.

Further, the present inventors have conducted extensive investigations for further increasing the current emitted from the surface conduction electron emission device into vacuum space (hereinafter called electron emission current $I_e$) and improving the efficiency of such current, and have found that the electron emission current $I_e$ in vacuum can be increased by adding a new step, called deposition process step, thereby forming deposition in the cracks of the conductive film.

The deposition process step is applied to the element after the forming process and is to repeat pulse application of a predetermined voltage under vacuum of $1\times10^{-2}$ to $1\times10^{-3}$ Pa to cause deposition from substances present in the atmosphere, thereby significantly increasing the emission current $I_e$.

However, for example in case of preparing an electron source consisting of multiple surface conduction electron emission devices connected in a simple matrix of m rows×n columns, and if the 1st to m-th rows are subjected to such deposition process in succession for example with a process time of 30 minutes per row, there will be required an enormous process time of 30×m minutes and the amount of substances in the atmosphere will vary in such prolonged period, whereby the deposition process cannot be applied under a same condition for all the lines and the uniform electron emission characteristics cannot be obtained. In consideration of the foregoing, the present applicant has proposed, in the Japanese Patent Application Laid-open No. 9-134666, a method for producing the electron source including the deposition step in which the multiple electron emission devices are divided into plural groups and the voltage application is conducted in succession to such groups thereby causing deposition in the electron emission portions of the plural electron emission devices.

SUMMARY OF THE INVENTION

The object of the present invention is to provide a method for advantageously producing an electron source and an image forming apparatus, and an electron source and an image forming apparatus produced with such method.

For attaining the above-mentioned object, the electron source and the image forming apparatus of the present invention and the producing method therefor are featured as follows.

The method of the present invention for producing an electron source consisting of plural electron emission devices having predetermined gaps and connected in a matrix by plural row wirings and plural column wirings is featured by having, after formation of a pre-element to constitute the electron emission device, a deposition step of dividing the plural pre-elements into plural groups, dividing each group into plural sub groups, taking at least a pre-element in each sub group as a unit, and executing a step of applying, simultaneously on all the groups, a voltage to the pre-elements in each sub group in succession to the above-mentioned units in succession, and in succession to the sub groups in a constant gaseous atmosphere, thereby forming a deposit in the gap of each pre-element.

The electron source of the present invention is featured by having plural electron emission devices having a predetermined gap and connected in a matrix by plural row wirings and plural column wirings, having a deposit in the gap and being produced by the above-mentioned method of the present invention for producing the electron source.

Further, the image forming apparatus of the present invention is featured by being provided with the above-mentioned electron source of the present invention and an image forming member adapted to form an image by irradiation with electron beam from the electron source.

Further, the image forming apparatus of the present invention is featured by preparing an electron source according to the above-mentioned method of the present invention for producing the electron source and combining thereto an image forming member for forming an image by the irradiation with electron beam from the electron source.

DETAILED DESCRIPTION OF THE PREFERRED EMBODIMENTS

Now the present invention will be clarified in detail by embodiments thereof, with reference to the accompanying drawings.

As a preferred example of the electron emission device constituting the electron source of the present invention, there will be explained, in detail, a surface conduction electron emission device.

Figure 2A:
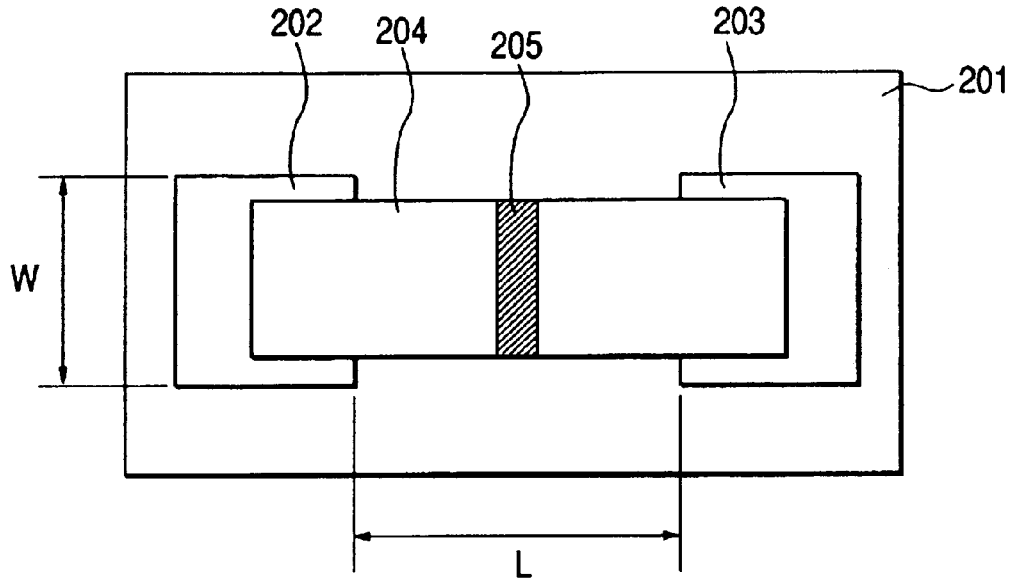
FIGS. 2A and 2B are schematic views showing the configuration of a surface conduction electron emission device to be applied to the electron source of the present invention.
Figure 2B:
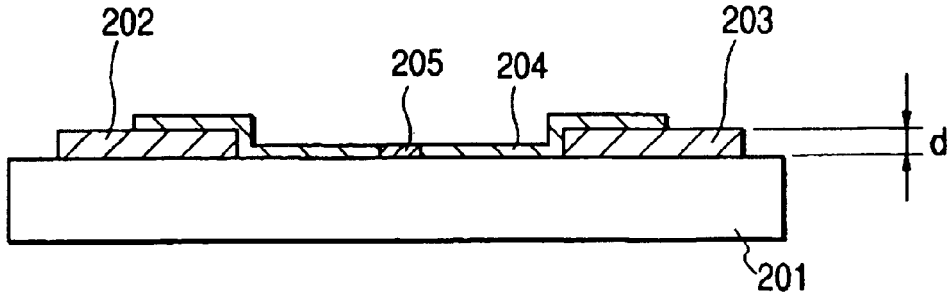

FIGS. 2A and 2B are respectively a plan view and a cross-sectional view, schematically showing the configuration of a planar surface conduction electron emission device to be employed in the present invention, wherein shown are a substrate 201, element electrodes 202, 203, a conductive film 204 and an electron emitting portion 205.

The substrate 201 can be composed for example of quartz glass, glass with reduced content of impurities such as Na, iron-containing glass, ceramics such as alumina, or a Si substrate.

The opposed element electrodes 202, 204 can be composed of an ordinary conductive material, that can be selected, for example, from a metal such as Ni, Cr, Au, Mo, W, Pt, Ti, Al, Cu, Pd or an alloy thereof, a printed conductor composed of a metal or a metal oxide such as Pd, Ag, Au, $RuO_2$ or Pd—Ag and glass, a transparent conductive material such as $In_2O_3$—$SnO_2$, or a semiconductive material such as polysilicon.

The gap L of the element electrodes, the length W of the element electrode, the shape of the conductive film 204 etc. are designed in consideration for example of the mode of use. The element electrode gap L is preferably selected within a range from several hundred nanometers to several hundred micrometers, and more it preferably from several micrometers to several ten micrometers. The element electrode length W can be selected within a range from several micrometers to several hundred micrometers in consideration of the resistance of the electrode and the electron emission characteristics. The thickness d of the element electrodes 202, 203 can be selected within a range from several ten nanometers to several micrometers.

The thickness of the conductive film 204 is suitably selected in consideration of the step coverage on the element electrodes 202, 203, resistance between the element electrodes 202, 203 and the forming conditions to be explained later, and is generally selected within a range preferably from several Angstroms to several hundred nanometers, more preferably 1 to 50 nm. The resistivity Rs thereof is in a range of $1\times10^2$ to $1\times10^7$ Ω/□.

In the present specification, the forming process will be explained by an electroforming utilizing an electric current, but the forming process is not limited to such process and includes any process for generating cracks in the film thereby forming a high resistance state.

The material constituting the conductive film 204 can be suitably selected from a metal such as Pd, Pt, Ru, Ag, Au, Ti, In, Cu, Cr, Fe, Zn, Sn, Ta, W or Pd, an oxide such as PdO, $SnO_2$, $In_2O_3$, PbO or $Sb_2O_3$, a boride such as $HfB_2$, $ZrB_2$, $LaB_6$, $CeB_6$, $YB_4$ or $GdB_4$, a carbide such as TiC, ZrC, HfC, TaC, SiC or WC, a nitride such as TiN, ZrN or HfN, a semiconductor such as Si or Ge and carbon.

The electron emitting portion 205 is constituted by high-resistance cracks formed in a part of the conductive film 204, and is therefore dependent on the thickness, film quality and material of the conductive film 204 and the method of electroforming to be explained later. Within the electron emitting portion 205, there may be present fine conductive particles of a particle size within a range from a fraction of a nanometer to several ten nanometers. Such fine conductive particles contain all the elements or a part thereof, constituting the conductive film 204. The electron emitting portion 205 and the conductive film 204 in the vicinity thereof have a deposit, preferably containing at least carbon.

Figure 3A:
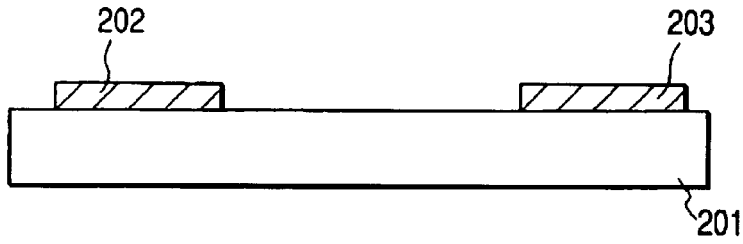
FIGS. 3A, 3B and 3C are schematic views showing the method for producing the surface conduction electron emission device shown in FIGS. 2A and 2B.
Figure 3B:
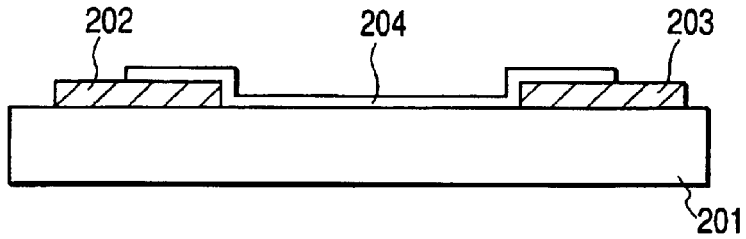
Figure 3C:
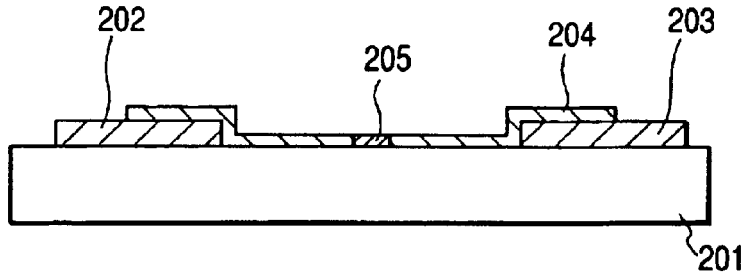

The surface conduction electron emission device described above may be prepared in various methods, of which an example is schematically shown in FIGS. 3A to 3C.

In the following an example of the method for producing the surface conductive electron emission device with reference to FIGS. 2A, 2B and 3A to 3C. In FIGS. 3A to 3C, components similar to those in FIGS. 2A and 2B are represented by same numbers.

The substrate 201 is sufficiently rinsed with detergent, deionized water and organic solvent, then the material for the element electrodes is deposited for example by vacuum evaporation or sputtering and the element electrodes 202, 203 are formed for example by a photolithographic process on the substrate 201 (FIG. 3A).

The substrate 201 bearing the element electrodes 202, 203 is coated with organimetallic solution to form an organimetallic film thereon. The organimetallic solution can be composed of solution of an organometallic compound of which principal component is the metal constituting the conductive film 204. The organometallic film is sintered by heating, and patterned by lift-off or etching to form the conductive film 204 (FIG. 3B). In addition to the coating of organometallic solution, the conductive film 204 may be formed for example by vacuum evaporation, sputtering, CVD, dispersion coating, dipping or spin coating.

Then a forming step is executed in succession. As an example of the forming step, there will be explained a method by electric current passing. By passing a current from an unrepresented power source between the element electrodes 202, 203, an electron emitting portion 205 with modified structure is formed in the conductive film 204 (FIG. 3C). The electroforming causes local destruction, deformation or denaturing of the conductive film 204, thereby forming a portion with modified structure, which is the electron emitting portion 205.

Figure 4A:
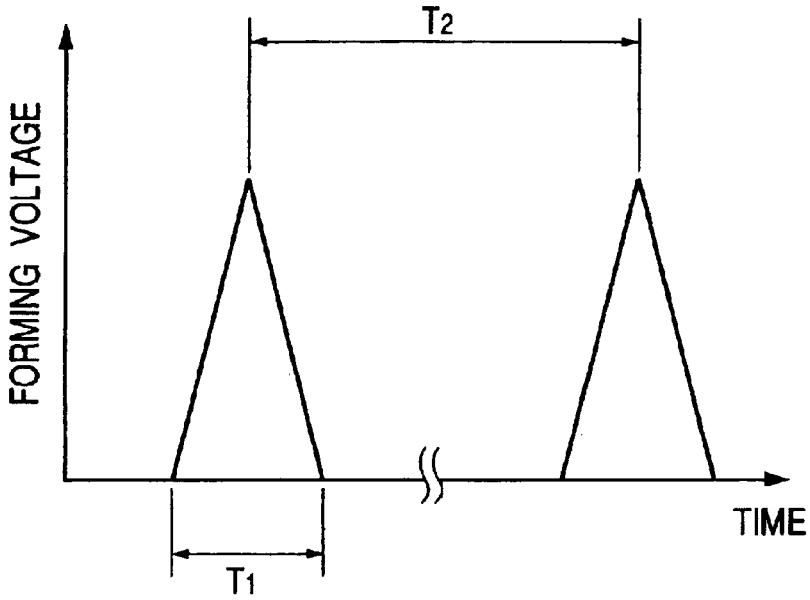
FIGS. 4A and 4B are charts showing examples of the voltage wave form for electroforming in the preparation of the electron emitting portion.
Figure 4B:
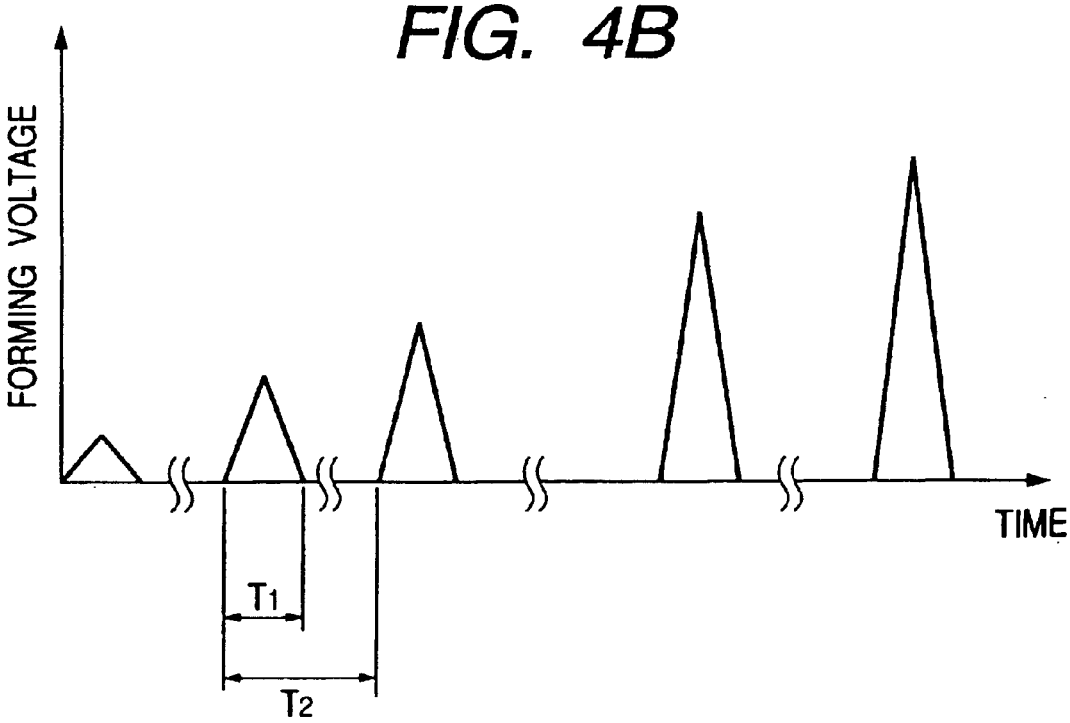

FIGS. 4A and 4B show examples of the voltage wave is form to be used in the electroforming.

The voltage wave form for the electroforming is preferably a pulsed wave form. There can be employed a method of applying pulses of a constant pulse height in succession as shown in FIG. 4A, or a method of applying voltage pulses of increasing pulse height, as shown in FIG. 4B.

In FIG. 4A, there are shown a pulse duration T1 and a pulse interval T2 of the voltage wave form. T1 and T2 are generally selected respectively in ranges of 1 μsec to 10 msec and 10 μsec to 10 msec. The height of the triangular wave (peak voltage in electroforming) is suitably selected according to the form of the surface conduction electron emission device. Under such conditions, the voltage is applied for example for a period of several seconds to several ten minutes. The pulse wave form is not limited to triangular wave, but may be of any desired form such as a rectangular wave.

T1 and T2 in FIG. 4B are similar to those in FIG. 4A. The height of the triangular wave (peak value in l: electroforming) is increased, for example, by a step of 0.1 V.

The end of the electroforming process can be detected by applying, during the pulse interval T2, a voltage that does not cause local destruction or deformation in the conductive film 204 and measuring the resulting current. For example, there is measured the current induced by the application of a voltage of about 0.1 V, and the electroforming is terminated when the calculated resistance reaches 1 MΩ. In the present invention, a state before completing producing process steps indispensable to the present invention is called as a pre-element. The pre-element before being subjected to a deposition process step indispensable to the present invention is, for example, in case of a surface conduction electron emitting device, desirably one after being subjected to an energization forming and provided with a structure to be formulated into the electron emitting device.

Subsequently the pre-element after the electroforming is subjected to a deposition step by a voltage application in a predetermined gaseous atmosphere to obtain the electron emission device. The above-mentioned gaseous atmosphere preferably contains an organic substance and can be formed by organic gas remaining in the atmosphere after evacuation of the vacuum chamber with an oil diffusion pump or a rotary pump, or by introducing gas of a suitable organic substance in the vacuum obtained by sufficient evacuation for example with an ion pump. The preferred gas pressure is variable depending on the aforementioned mode of use, shape of the vacuum chamber and kind of the organic substance and is suitable selected according to the situation.

Suitable examples of the organic substance include aliphatic hydrocarbons such as alkanes, alkenes or alkynes, aromatic hydrocarbons, alcohols, aldehydes, ketones, amines, phenols, and organic acids such as carboxylic acids or sulfonic acids. More specifically there can be employed a saturated hydrocarbon represented by a general formula $C_nH_{2n+2}$ such as methane, ethane or propane, an unsaturated hydrocarbon represented by a general formula $C_nH_{2n}$ such as ethylene or propylene, benzene, toluene, methanol, ethanol, formaldehyde, acetaldehyde, acetone, methyletheylketone, methylamine, ethylamine, phenol, formic acid, acetic acid, propionic acid or a mixture thereof.

Through this process, a deposit is deposited from the substance present in the atmosphere into the gap of the pre-element to constitute the electron emitting portion (crack portion 205 of the conductive film 204) thereby inducing a significant change in the device current $I_f$ and the emission current $I_e$. The end of the deposition step is judged suitably by measuring the device current $I_f$ and the emission current $I_e$. The pulse duration, pulse interval and pulse height are suitably selected.

The above-mentioned deposit is carbon and carbon compounds in case of using gas containing organic substances, and, more specifically graphite (including so-called HOPG, PG and GC wherein HOPG is graphite having a substantially complete graphite crystal structure, PG is graphite with a crystal grain size of about 200 Å with a somewhat distorted crystal structure and GC is graphite with a crystal grain size of about 20 Å and a more distorted crystal structure) or amorphous carbon (indicating amorphous carbon and a mixture of amorphous carbon and microcrystalline graphite mentioned above) with a film thickness preferably not exceeding 50 nm and more preferably not exceeding 30 nm.

The electron emission device obtained through the above-described process is preferably subjected to a stabilizing step, which is to discharge the substance in the vacuum chamber. The evacuation apparatus for evacuating the vacuum chamber is preferably free of any oil, in order that the characteristics of the device are not affected by the oil generated from the evacuation apparatus. Specific example of such evacuation apparatus include a sorption pump and an ion pump.

In case the aforementioned deposition step employs the oil diffusion pump or rotary pump as the evacuation apparatus and utilizes the organic gas resulting from the oil component generated from such apparatus, the partial pressure of such component should be maintained as low as possible. The partial pressure of the organic component in the vacuum vessel should be such that the above-mentioned carbon and carbon compound do not deposited anew, preferably not exceeding $1.3\times10^{-6}$ Pa, more preferably not exceeding $1.3\times10^{-8}$ Pa. In addition, in evacuating the interior of the vacuum vessel, the entire vacuum vessel is preferably heated to facilitate elimination of the molecules of the organic substance absorbed on the internal wall of the vacuum vessel or the electron emission device. The heating is preferably conducted as long as possible at 80° to 250° C., preferably at 150° C. or higher, but such condition is not restrictive and there may be adopted conditions suitable selected according the size and shape of the vacuum vessel, the configuration of the electron emission device etc. The pressure in the vacuum vessel has to be as low as possible, preferably not exceeding $1\times10^{-5}$ Pa and more preferably not exceeding $1.3\times10^{-8}$ Pa.

The atmosphere in the driving operation after the above-mentioned stabilizing step is preferably that at the end of the stabilizing step, but, if the substance in the atmosphere in the deposition step is sufficiently eliminated, the sufficiently stable characteristics can be maintained even if the level of vacuum is somewhat deteriorated. The use of such vacuum atmosphere allows to suppress the new deposition and to eliminate $H_2O$, $O_2$ etc. absorbed in the vacuum vessel or on the substrate, thereby stabilizing the device current $I_f$ and the emission current $I_e$.

Now there will be explained, with reference to FIGS. 6 and 7, the basic characteristics of the electron emission device obtained through the above-described process and constituting the electron source of the present invention.

Figure 6:
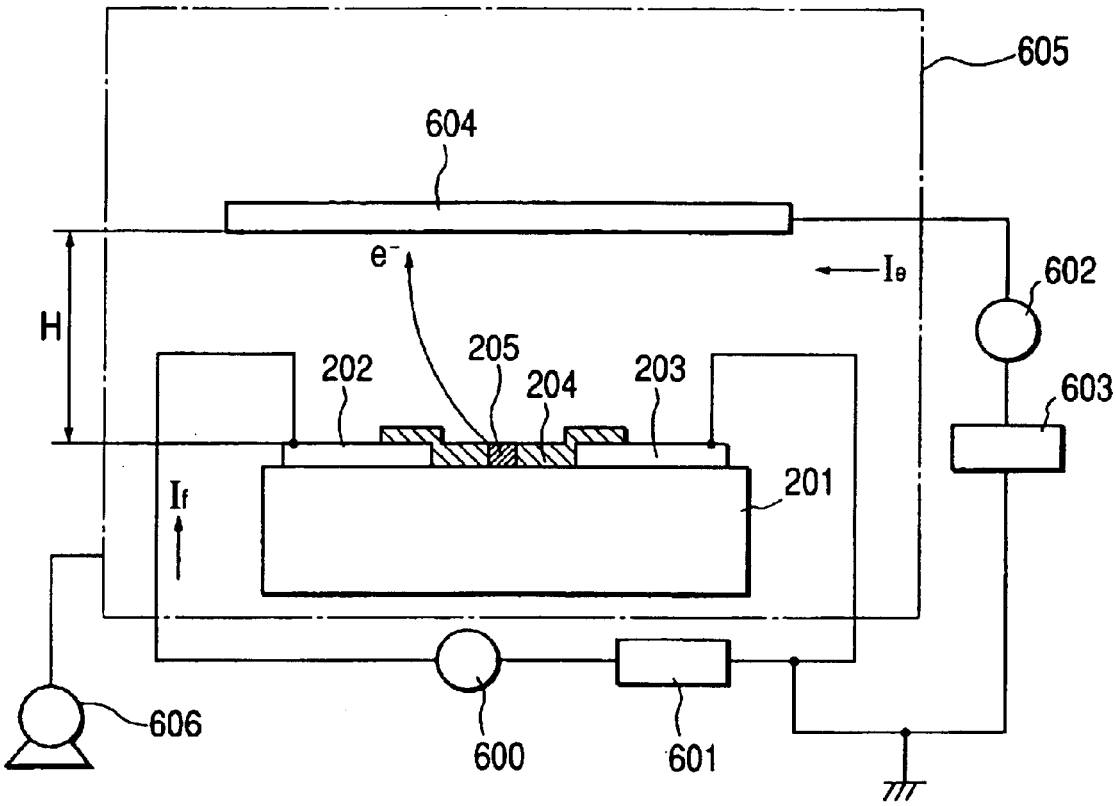
FIG. 6 is a schematic view showing an example of the vacuum processing apparatus for evaluating the electron emission characteristics of the electron source of the present invention.

FIG. 6 is a schematic view showing an example of the vacuum process apparatus, which also serves as a measurement/evaluation apparatus. In FIG. 6, components same as those in FIGS. 2A and 2B are represented by same numbers.

In FIG. 6, there are shown a vacuum vessel 605 and a vacuum pump 606. In the vacuum vessel 605 there is positioned an electron emission device provided with a substrate 201 constituting the electron emission device, element electrodes 202, 203, a conductive film 204, and an electron emitting portion 205. There are also shown a power source 601 for applying the device voltage $V_f$ to the electron emission device, an ammeter 600 for measuring the device current $I_f$ in the conductive film 204 between the element electrodes 202, 203, an anode electrode 604 for collecting the emission current $I_e$ emitted from the electron emitting portion 205 of the element, a high voltage power source 603 for applying a voltage to the anode 604, and an ammeter 602 for measuring the emission current $I_e$ emitted from the electron emitting portion 205 of the element. As an example, the anode 604 is given a voltage within a range of 1 to 10 kV, and the measurement is executed with a distance H between the anode 604 and the electron emission device within a range of 2 to 8 mm.

In the vacuum vessel 605, there is provided equipment required for the measurement in the vacuum, such as an unrepresented vacuum meter, in order to execute measurement and evaluation in the desired vacuum condition.

The vacuum pump 606 is composed of an ordinary high vacuum pump such as a turbo pump or a rotary pump, and an ultra high vacuum system composed for example of an ion pump. The entire vacuum process apparatus, including the substrate of the electron emission device, can be heated with an unrepresented heater. Therefore, the steps after the aforementioned electroforming can be executed with such vacuum process apparatus.

Figure 7:
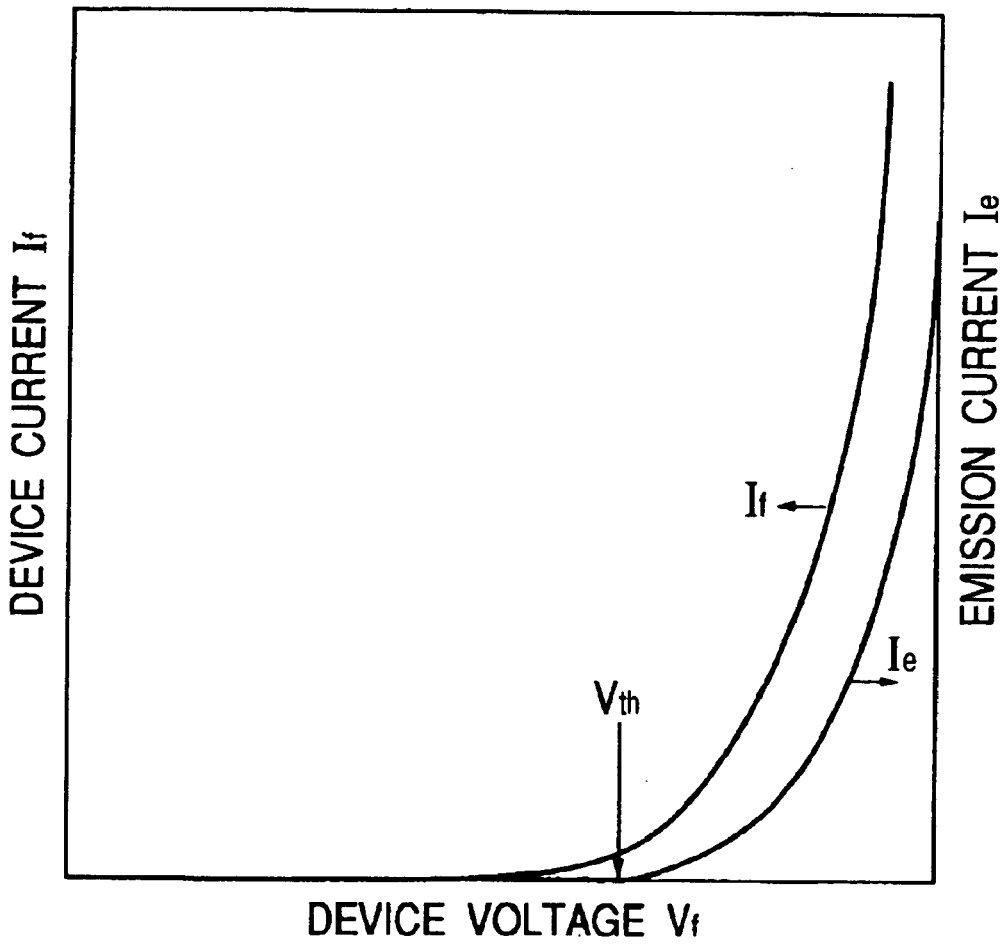
FIG. 7 is a chart showing the relationship among the emission current $I_e$, device current $I_f$ and device voltage $V_f$ of the electron emission device constituting the electron source of the present invention.

FIG. 7 is a chart schematically showing the relationship of the emission current $I_e$, device current $I_f$ and device voltage $V_f$ measured with the vacuum process apparatus shown in FIG. 6. In FIG. 7, the emission current $I_e$, being significantly smaller than the device current $I_f$, is represented in an arbitrary scale. The ordinate and the abscissa are linearly scaled.

As will be apparent from FIG. 7, the surface conduction electron emission device employed in the present invention has the following three features on the emission current $I_e$.

Firstly, this element shows an abrupt increase of the emission current $I_e$ under the application of a device voltage exceeding a certain value (threshold voltage $V_{th}$ shown in FIG. 7), but shows scarce emission current $I_e$ under the threshold voltage $V_{th}$. It is therefore a non-linear element having a distinct threshold voltage $V_{th}$ for the emission current $I_e$.

Secondly, the emission current $I_e$ monotonously increases as a function of the device voltage $V_f$, so that the emission current $I_e$ can be controlled by the device voltage $V_f$.

Thirdly, the emission charge collected by the anode 604 depends on the time of application of the device voltage $V_f$. Thus the amount of charge collected by the anode 604 can be controlled by the time of application of the device voltage $V_f$.

As will be apparent from the foregoing description, the surface conduction electron emission device can easily control the electron emission characteristics according to the input signal. Based on this property, it can be applied in various manner, for example to an electron source or an image forming apparatus constituting by an arrange of multiple electron emission devices.

FIG. 7 shows an example in which the device current $I_f$ monotonously increases as a function of the device voltage $V_f$ (hereinafter called MI characteristics). However, there may be obtained a case (not shown) where the device current $I_f$ shows voltage-controlled negative resistance characteristics (hereinafter called VCNR characteristics) with respect to the device voltage $V_f$. These characteristics can be controlled by the aforementioned process.

The electron source of the present invention can be constituted by arranging, on the substrate, a plurality of the electron emission devices with a gap, including the aforementioned surface conduction electron emission devices.

The surface conduction electron emission device has the aforementioned three features. More specifically, the electron emission from the surface conduction electron emission device can be controlled, above the threshold voltage, by the height and duration of the pulsed voltage applied between the opposed element electrodes, but scarcely takes place below the threshold voltage. Also in case a plurality of the electron emission devices are arranged, this property can be utilized to select the surface conduction electron emission device and to control the amount of electron emission according to the input signal, by adequately applying a pulsed voltage to each element.

Figure 5:
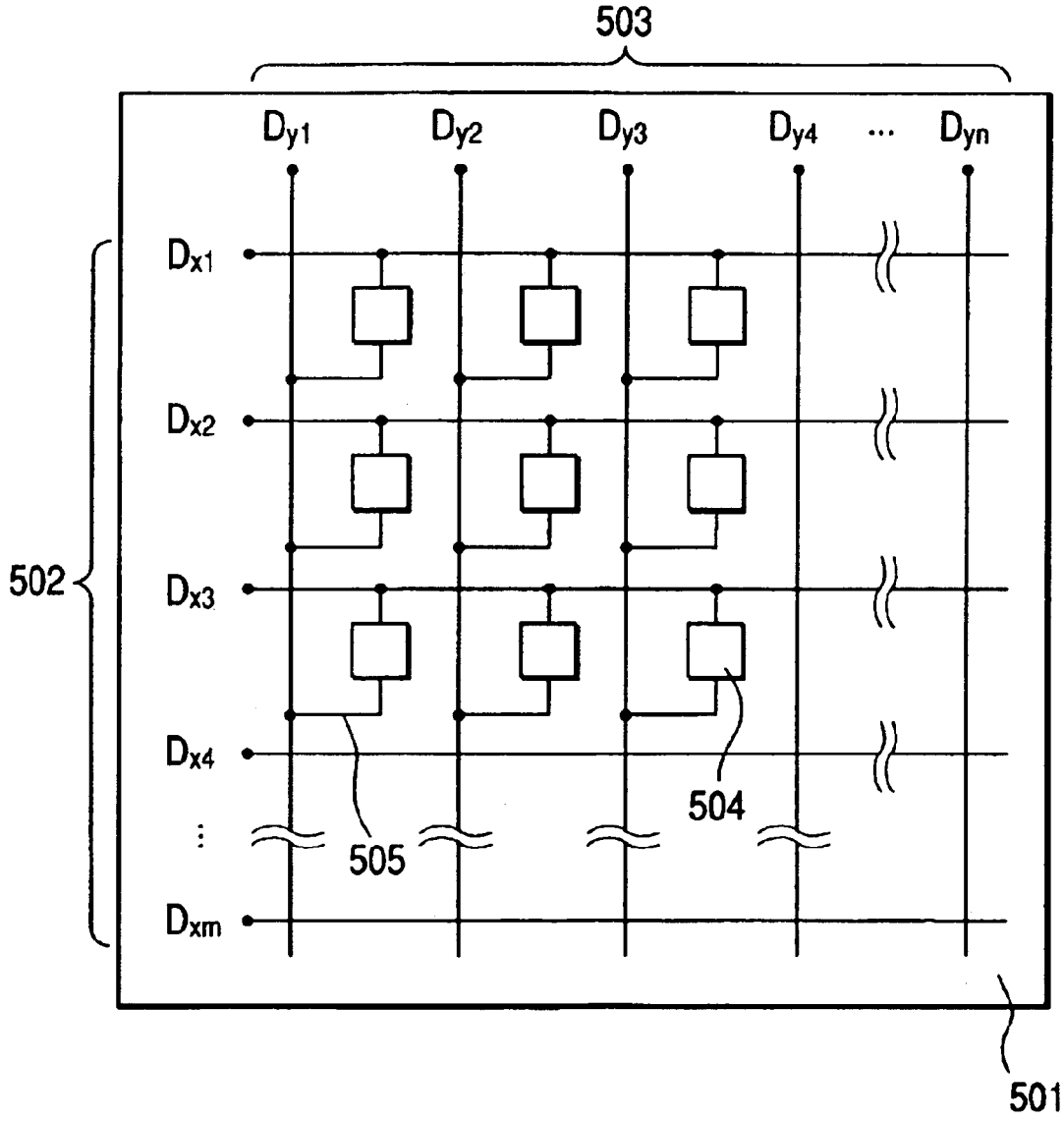
FIG. 5 is a schematic view showing the wiring configuration of the electron source of the present invention.

In the following there will be explained, with reference to FIG. 5, an example of the electron source of the present invention utilizing the above-described electron emission devices, based on this principle. FIG. 5 is a schematic view of an embodiment of the electron source of the present invention, wherein shown are an electron source substrate 501, X-direction wirings 502, Y-direction wiring 503, surface conduction electron emission devices 504 and wirings 505.

The m X-direction wirings 502, consisting of $D_{x1}$, $D_{x2}$, . . . , $D_{xm}$, can be composed of a conductive metal formed by printing or sputtering. The material, thickness and width of the wiring can be suitably selected. The n Y-direction wirings 503, consisting of $D_{y1}$, $D_{y2}$, . . . , $D_{yn}$, can be formed similarly to the X-direction wirings 502. Between the m X-direction wirings 502 and the n Y-direction wirings 503, there is provided an unrepresented interlayer insulation layer for mutual separation thereof (m, n being positive integers).

The unrepresented interlayer insulation layer is composed for example of $SiO_2$ formed by vacuum evaporation, printing or sputtering. For example it is formed in a desired shape on the entire substrate 501 or a part thereof, bearing the X-direction wirings 502, and the film thickness, material and forming method are suitable so selected as to withstand the potential difference at the crossing points of the X-direction wirings 502 and the Y-direction wirings 503, which are extracted as external terminals.

Paired electrodes (not shown) constituting the surface conduction electron emission devices 504 are electrically connected to the m X-direction wirings 502 and the n Y-direction wirings 503 by wirings 505 composed for example of a conductive metal.

The materials constituting the X-direction electrodes 502 and the Y-direction wirings 503, the material constituting the wirings 505 and the material constituting the paired element electrodes may be same or different in all the constituent elements or a part thereof. These material may be suitably selected for example from the aforementioned materials for the element electrodes. In case the material constituting the element electrodes is same as that of the wirings, the wirings connected to the element electrodes may also be considered as the element electrodes.

The X-direction wirings 502 are connected to unrepresented scanning signal application means for applying a scanning signal for selecting a row of the surface conduction electron emission devices arranged in the X-direction. On the other hand, the Y-direction wirings 503 are connected to unrepresented modulation signal generation means for modulating, according to the input signal, each column of the surface conduction electron emission devices arranged in the Y-direction. The drive voltage applied to each electron emission device is given as a difference voltage between the scanning signal and the modulation signal supplied thereto.

In the above-described configuration, the wirings of a simple matrix configuration are adopted to select individual element and to individually drive the selected element.

Now the image forming apparatus of the present invention will be explained with reference to FIGS. 9, 10A, 10B and 11, which are respectively a schematic view showing an example of the display panel of the image forming apparatus of the present invention, schematic views of a fluorescent film employed in the display panel shown in FIG. 9, and a block diagram showing an example of the drive circuit for executing display according to the NTSC television signal.

Figure 9:
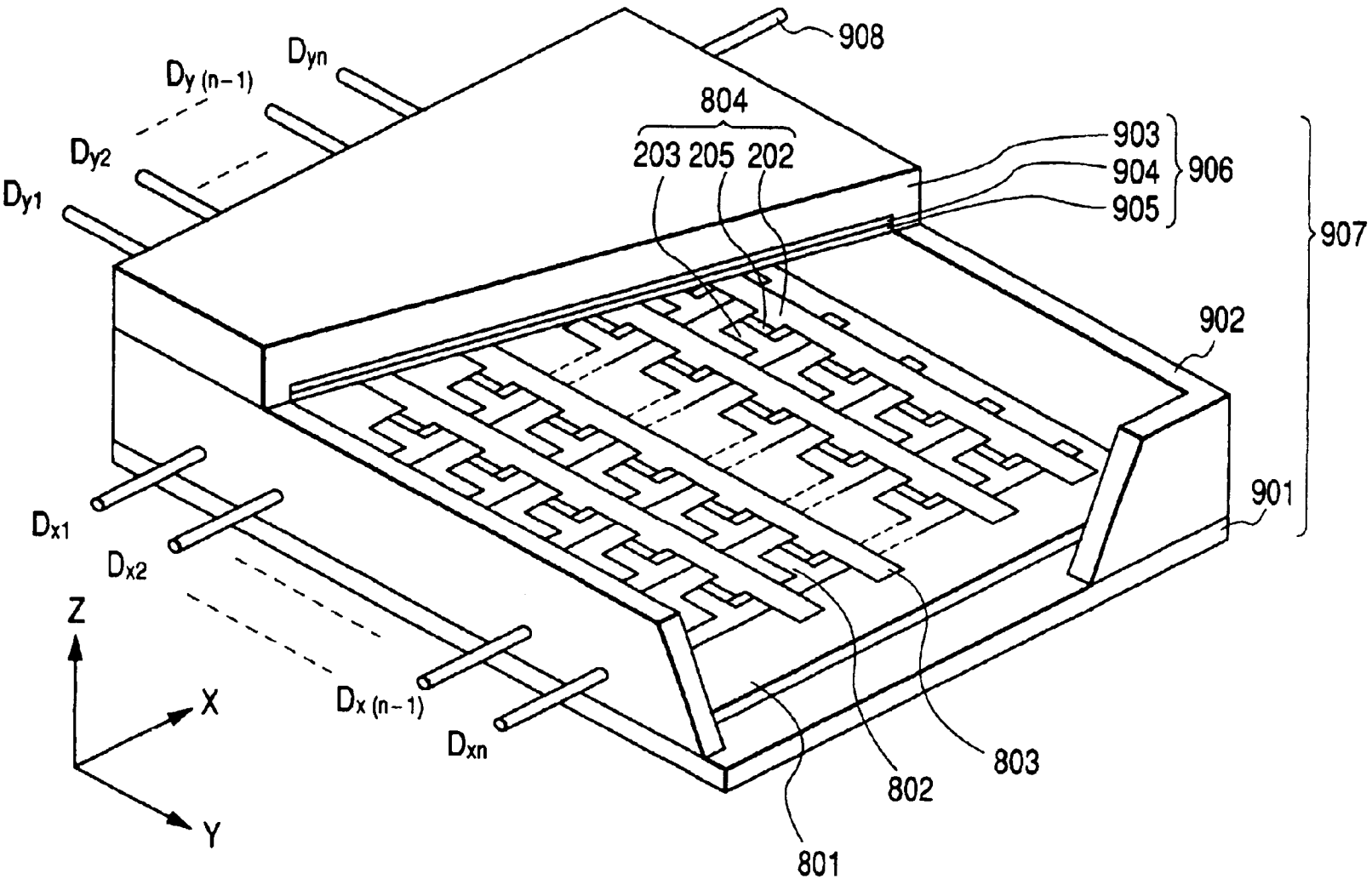
FIG. 9 is a schematic perspective view showing an example of the display panel of the image forming apparatus of the present invention.

Referring to FIG. 9, there are shown an electron source substrate 801 bearing plural electron emission devices, a rear plate 901 for fixing the electron source substrate 801, and a face plate 906 having a fluorescent film 904 and a metal back 905 on the internal face of a glass substrate 903. There are also shown a supporting frame 902 to which the rear plate 901 and the face plate 906 are adhered for example with frit glass of a low melting point. 804 corresponds to the pre-element of the electron emission device shown in FIGS. 2A and 2B prior to the deposition step, and 802, 803 indicate the X- and Y-direction wirings connected to the paired element electrodes of the surface conduction electron emission devices. The conductive film is omitted for the purpose of simplicity.

An external container 907 is composed, as explained above, of the face plate 906, the support frame 902, and the rear plate 901. The rear plate 901, being principally provided for reinforcing the strength of the substrate 801, may be dispensed with in case the substrate 801 itself is strong enough. Thus the support frame 902 may be directly sealed to the substrate 801 to constitute the external container 907 by the face plate 906, the support frame 902 and the substrate 801. On the other hand, an unrepresented support member, called spacer, may be provided between the face plate 906 and the rear plate 901 to obtain the external container 907 sufficiently resistant to the atmospheric pressure.

Figure 10A:
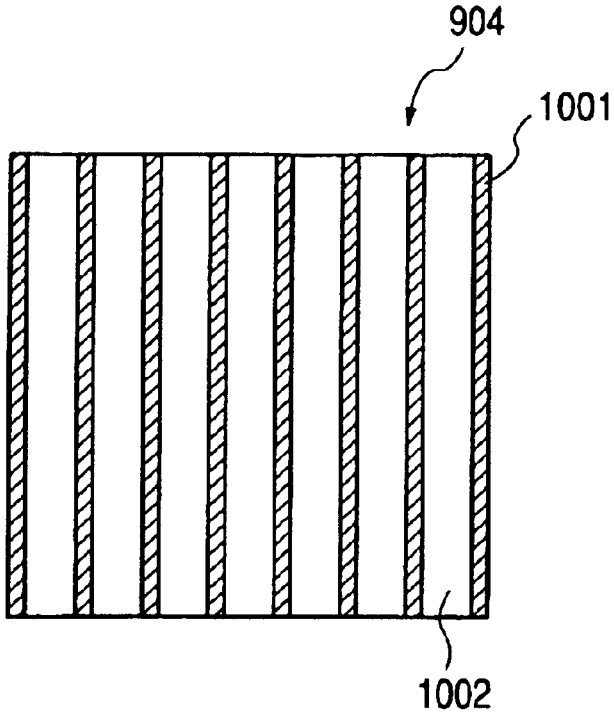
FIGS. 10A and 10B are schematic views showing a fluorescent film constituting the display panel shown in FIG. 9.
Figure 10B:
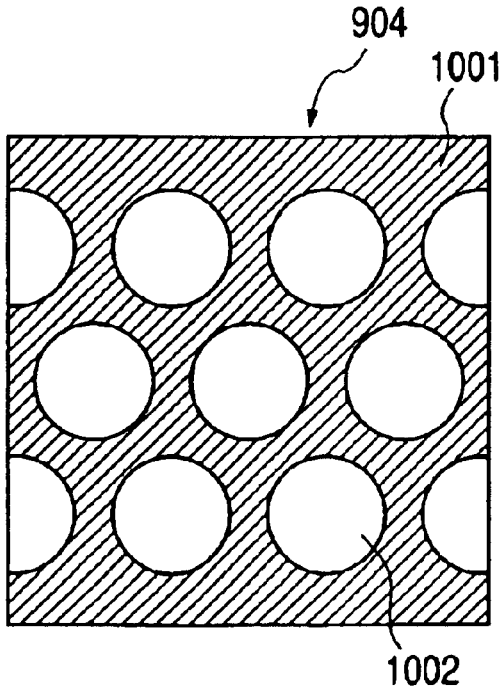

FIGS. 10A and 10B are schematic views of the fluorescent film, which can be solely composed of a fluorescent material in case of a monochromatic display. In case of a color display, the fluorescent film can be composed of black conductive materials 1001 which is called black strips (FIG. 10A) or black matrix (FIG. 10B) and fluorescent members 1002. The black strips or black matrix is provided in order to reduce the color mixing by blackening the boundaries of the fluorescent members 1002 of three primary colors required for the color display, and to suppress the loss of contrast induced by the reflection of external light on the fluorescent film 904. Such black strips or black matrix can be composed of an ordinarily employed material principally composed of graphite, or a material with electric conductivity and with low light transmission and reflection.

The fluorescent material may be coated on the glass substrate 903 by precipitation method or printing method, both in the monochromatic and color displays. On the internal surface of the fluorescent film 904, there is usually provided a metal back 905. Such metal back 905 is provided in order to guide the light, emitted from the fluorescent member to the inside, by mirror reflection toward the face plate 906 thereby increasing the luminance, also to function as an electrode for applying an electron beam accelerating voltage, and to protect the fluorescent member from the damage resulting from the collision of negative ions generated in the external container 907. The metal back 905 can be prepared, after the preparation of the fluorescent film, by smoothing the internal surface thereof (usually called "filming") and thereafter depositing aluminum for example by vacuum evaporation.

The face plate 906 may be further provided, at the outside of the fluorescent film 904, with a transparent electrode (not shown) for improving the conductivity of the fluorescent film 904.

In the aforementioned sealing operation, sufficient alignment is indispensable in case of color display, since the fluorescent member of each color has to be positioned corresponding to the electron emission device.

Figure 13:
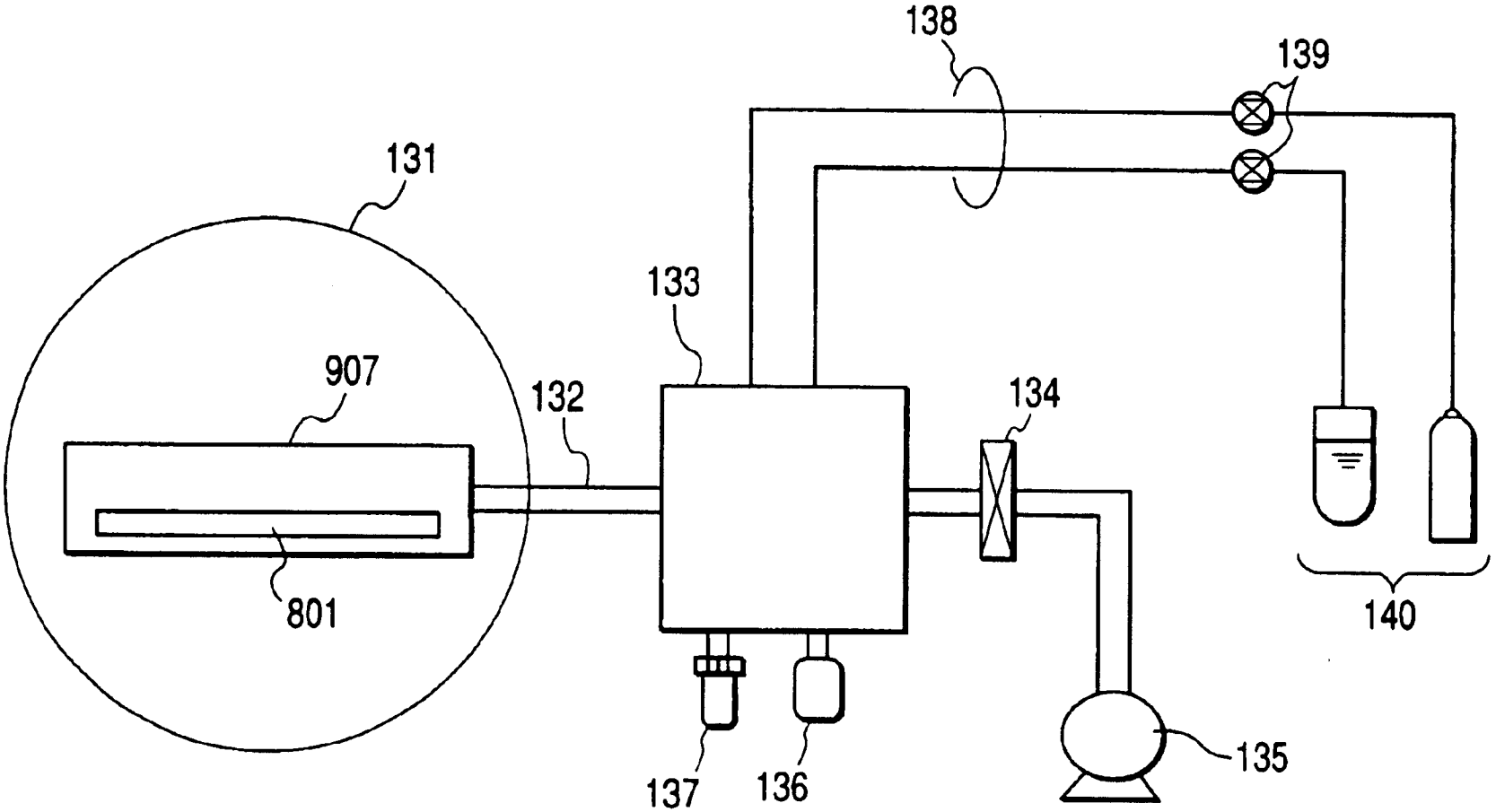
FIG. 13 is a schematic view showing a vacuum apparatus for forming and deposition step in the method of the present invention for producing the electron source.

In the following there will be explained an example of the method for producing the display panel, employed in the image forming apparatus shown in FIG. 9. FIG. 13 is a schematic view of the apparatus to be employed in this method.

A display panel 131 is connected through an evacuation pipe 132 to a vacuum chamber 133, which is further connected to an evacuation apparatus 135 through a gate valve 134. The vacuum chamber 133 is provided with a pressure gauge 136, a quadrapole mass spectrometer 137 etc. for measuring the internal pressure and the partial pressures of the components in the atmosphere.

As the internal pressure etc. in the external container 907 of the display panel 131 are difficult to measure, the process conditions are controlled by measuring the pressure etc. of the vacuum chamber 133. The vacuum chamber 133 is provided further with gas introducing lines 138 for introducing necessary gas into the vacuum chamber 133 thereby controlling the atmosphere therein. At the other ends of the gas introducing lines 138, there are connected material sources 140 where materials to be introduced are stored in ampoules or canisters. On the gas introducing lines 138, there are provided gas introduction control means 139 for controlling the introducing rates of the materials to be introduced. The gas introduction control means 139 are composed for example of valves capable of controlling the leaking rate such as slow leak valves or mass flow controllers, depending on the kind of the introduced material.

Figure 12:
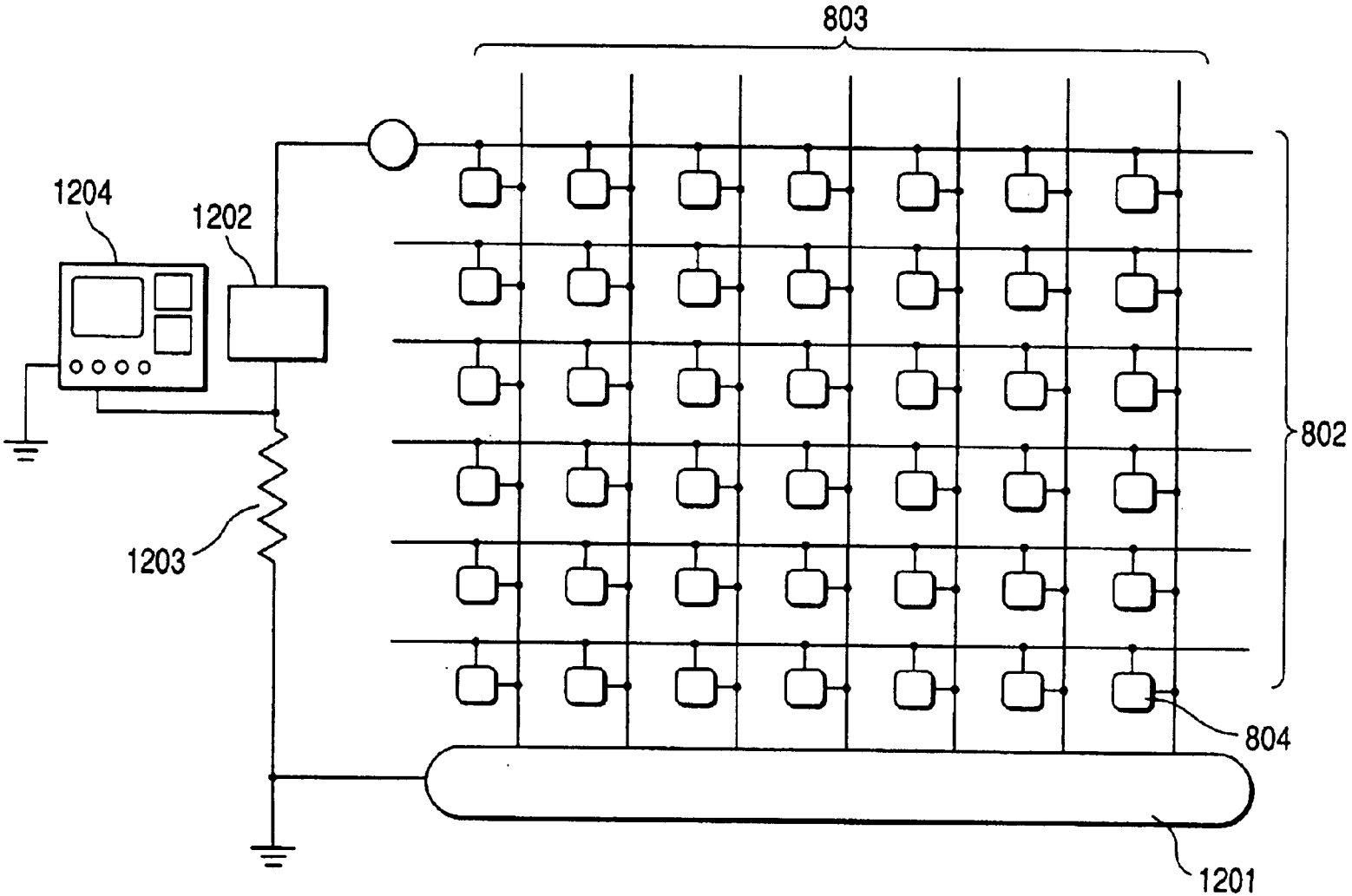
FIG. 12 is schematic view showing the wiring method for forming and deposition step in the method of the present invention for producing the electron source.

The forming operation is executed by evacuating the interior of the external container 907 by the apparatus shown in FIG. 13. In this forming operation, as shown in FIG. 12, the Y-direction wirings 803 are connected to a common electrode 1201 and a voltage pulse is simultaneously applied by a power source 1202 to the element electrodes connected to one of the X-direction wirings 802. The conditions of the process, such as judgment of end of the forming, can be suitably selected according to the aforementioned method for the forming operation of the individual element. It is also possible to execute the forming operation collectively on the element electrodes connected to the plural X-direction wirings 802 by applying the pulses of successively displaced phases (phase scrolling) to the plural X-direction wirings 802. In FIG. 13 there are also shown a resistor 1203 for current measurement, and an oscilloscope 1204 for current measurement.

After the forming operation, there is executed the deposition step. The deposition step will be explained later in more details by a voltage application method, and the gaseous atmosphere to be employed in the deposition will be explained in the following.

After sufficient evacuation of the external container 907, predetermined gas is introduced therein through the gas introducing lines 138. Otherwise, as already explained in the deposition step for the individual element, there may be utilized organic substances remaining in the vacuum atmosphere after evacuation with an oil diffusion pump or a rotary pump. The voltage application to each pre-element in thus formed gas atmosphere causes deposition of a deposit, preferably of carbon, a carbon compound or a mixture thereof, on each pre-element to drastically increase the amount of electron emission as in the case of individual element.

After the deposition step, a stabilizing step is preferably executed as in the case of individual element. While the external container 907 is heated to 80° to 250° C., the interior is evacuated through the evacuation pipe 132 by an oil-free evacuation apparatus 135 such as an ion pump or a sorption pump to sufficient reduce the organic substances in the atmosphere, and the evacuation pipe is sealed off with a burner. A getter treatment may be applied in order to maintain the pressure in the external container 907 after the sealing. This treatment is effected by heating a getter provided in a predetermined position (not shown) in the external container 907 by resistance heating or high frequency heating immediately before the sealing of the external container 907 or after the sealing thereof, thereby forming an evaporated film. The getter is usually composed principally of Ba etc. and is capable of maintaining the atmosphere in the external container 907 by the absorbing function of the evaporated film.

Figure 11:
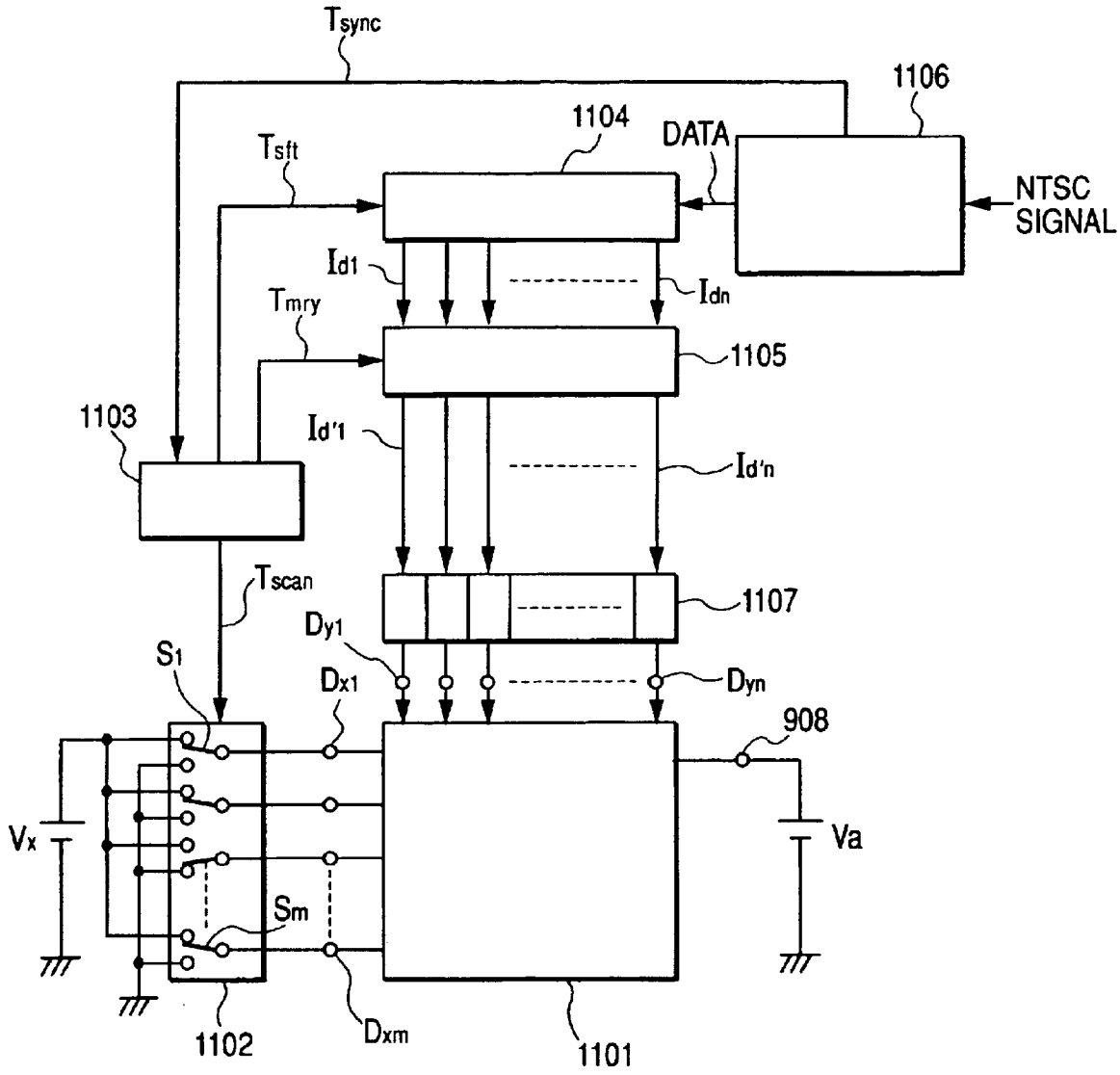
FIG. 11 is a schematic view showing an example of the driving circuit for executing display with the display panel shown in FIG. 9, according to an NTSC television signal.

In the following there will be explained, with reference to FIG. 11, an example of the drive circuit for effecting television display, based on the NTSC television signal, on the display panel constituted with the electron source of the present invention. In FIG. 11 there are shown a display panel 1101, a scanning circuit 1102, a control circuit 1103, a shift register 1104, a line memory 1105, a synchronization signal separation circuit 1106, a modulation signal generator 1107, and DC voltage sources $V_x$ and $V_a$.

The display panel 1101 is connected with the external electrical circuits through terminals $D_{x1}$ to $D_{xm}$, $D_{y1}$ to $D_{yn}$ and a high voltage terminal 908. The terminals $D_{x1}$ to $D_{xm}$ receive scanning signals for driving the surface conduction electron emission devices connected in a matrix of m rows by n columns, in succession by a row (n elements).

The terminals $D_{y1}$ to $D_{yn}$ receive modulation signals for controlling the output electron beams from the surface conduction electron emission devices of a row selected by the aforementioned scanning signal. The high voltage terminal 908 receives a DC voltage for example of 10 kV from the DC voltage source $V_a$, as an acceleration voltage for providing the electron beam emitted from the surface conduction electron emission device with an energy sufficient for exciting the fluorescent member.

In the following there will be explained the scanning circuit 1102, which is provided therein with m switching elements (schematically represented by $S_1$ to $S_m$ in FIG. 11). Each of the switching element selects either the output voltage of the DC voltage source $V_n$ or "0" V (ground level), and the switching elements are electrically connected with the terminals $D_{x1}$ to $D_{xm}$ of the display panel 1101. The switching elements $S_1$ to $S_n$ are operated according to a control signal $T_{scan}$ released from the control circuit 1103 and can be constituted by a combination of switching elements such as FET.

The DC voltage source $V_x$ is so set to output a constant voltage that, based on the characteristics (electron emission threshold voltage) of the surface conduction electron emission device, the drive voltage applied to the non-scanned element is lower than the electron emission threshold voltage.

The control circuit 1103 has a function of matching the functions of various units so as to execute adequate display based on the externally entered image signal. The control circuit 1103 generates control signals $T_{SCAN}$, $T_{aft}$ and $T_{mry}$, based on a synchronization signal $T_{sync}$ supplied from the sync signal separation circuit 1106.

The synchronization signal separation circuit 1106, for separating the synch signal component and the luminance signal component from the externally entered NTSC television signal, can be composed for example of ordinary frequency separation (filter) circuits. The synchronization signal separated by the sync signal separation circuit 1106 is composed of a vertical sync signal and a horizontal sync signal, but is represented as $T_{sync}$ for the purpose of simplicity. The luminance signal component separated from the aforementioned television signal is represented for the purpose of brevity as DATA, which is entered into the shift register 1104.

The shift register 1104 is to execute, for each image line, serial/parallel conversion of the DATA signal entered time-sequentially, and functions according to the control signal $T_{aft}$ supplied from the aforementioned control circuit 1103 (thus, the control signal $T_{aft}$ being also regarded as a shift clock signal for the shift register 1104). The serial/parallel converted image data of a line (corresponding to the drive data for n electron emission devices) are outputted as n parallel signals $I_{d1}$ to $I_{dn}$ from the shift register 1104.

The line memory 1105 stores the image data of a line for a necessary period, and suitably stores the signals $I_{d1}$ to $I_{dn}$ according to the control signal $T_{mry}$ from the control circuit 1103. The stored contents are outputted as $I_{d.1}$ to $I_{d.n}$, and entered into the modulation signal generator 1107.

The modulation signal generator 1107 is a signal source for adequately controlling the surface conduction electron emission devices respectively according to the image data $I_{d.1}$ to $I_{d.n}$, and supplies the surface conduction electron emission devices in the display panel 1101 with the output signals through the terminals $D_{y1}$ to $D_{yn}$.

As explained in the foregoing, the electron emission device in which the present invention is applied has the following features on the emission current $I_e$. It has a distinct threshold voltage $V_{th}$ for the electron emission, and causes electron emission only under the application of a voltage exceeding $V_{th}$. Above the threshold voltage, the emission current varies according to the change in the voltage applied to the element. Therefore, in case of application of a pulse voltage to the element, the electron emission does not take place under the application of a voltage below the threshold value, but is induced by the application of a voltage exceeding the threshold value. In this operation, the intensity of the output electron beam can be controlled by the change in the pulse height $V_m$. Also the total charge amount of the output electron beam can be controlled by a change in the pulse duration $P_w$.

Consequently the voltage modulation method or the pulse width modulation method can be employed for modulating the electron emission device according to the input signal. In case of the voltage modulation method, the modulation signal generator 1107 can be composed of a voltage modulating circuit for suitably modulating the pulse height according to the input data.

In case of the pulse width modulation method, the modulation signal generator 1107 can be composed of a pulse width modulating circuit for suitably modulating the pulse width according to the input data.

The shift register 1104 and the line memory 1105 can be digital type or analog type, as they are only required to execute the serial/parallel conversion of the image signal and the storage thereof at a predetermined rate.

In case of digital type, the output signal DATA of the sync signal separation circuit 1106 has to be digitized, and this can be achieved by providing an A/D converter at the output of the circuit 1106. Also the circuit to be employed in the modulation signal generator 1107 is somewhat different, depending on whether the output signal of the line memory 1105 is digital or analog. In case of the voltage modulation method utilizing digital signal, the modulation signal generator 1107 is composed for example of a D/A conversion circuit, with an amplifying circuit etc. if necessary. In case of the pulse width modulation method, the modulation signal generator 1107 is composed for example of a high-speed oscillator, a counter for counting the wave number outputted from the oscillator and a comparator for comparing the output of the counter and the output of the memory. If necessary, there may be added an amplifier for voltage amplification of the pulse width modulated signal, from the comparator, to the drive voltage of the surface conduction electron emission device.

In case of the voltage modulation method utilizing analog signal, the modulation signal generator 1107 can be composed for example of an amplifying circuit based on an operational amplifier, with a level shift circuit if necessary. In case of the pulse width modulation method, there can be employed a voltage-controlled oscillator (VOC), eventually with an amplifier for voltage amplification to the drive voltage of the surface conduction electron emission device.

In the image display apparatus of the present invention having the above-described configuration, the electron emission devices cause electron emission by the voltage application through the external terminals $D_{x1}$ to $D_{xm}$, $D_{y1}$ to $D_{yn}$. At the same time, a high voltage is applied to the metal back 905 or the transparent electrode (not shown) through the high voltage terminal 908, thereby accelerating the electron beams. The accelerated electrons collide with the fluorescent film 904, thus causing light emission and forming an image.

The above-described configuration of the image forming apparatus is merely an example of the image forming apparatus of the present invention, and is subject to various modifications based on the technical concept of the present invention. There has been explained the NTSC television signal, but such form is not restrictive and the input signal can be of PAL or SECAM system or can be a television signal based on a larger number of scanning lines (for example of the high definition television such as of MUSE system).

Figure 17:
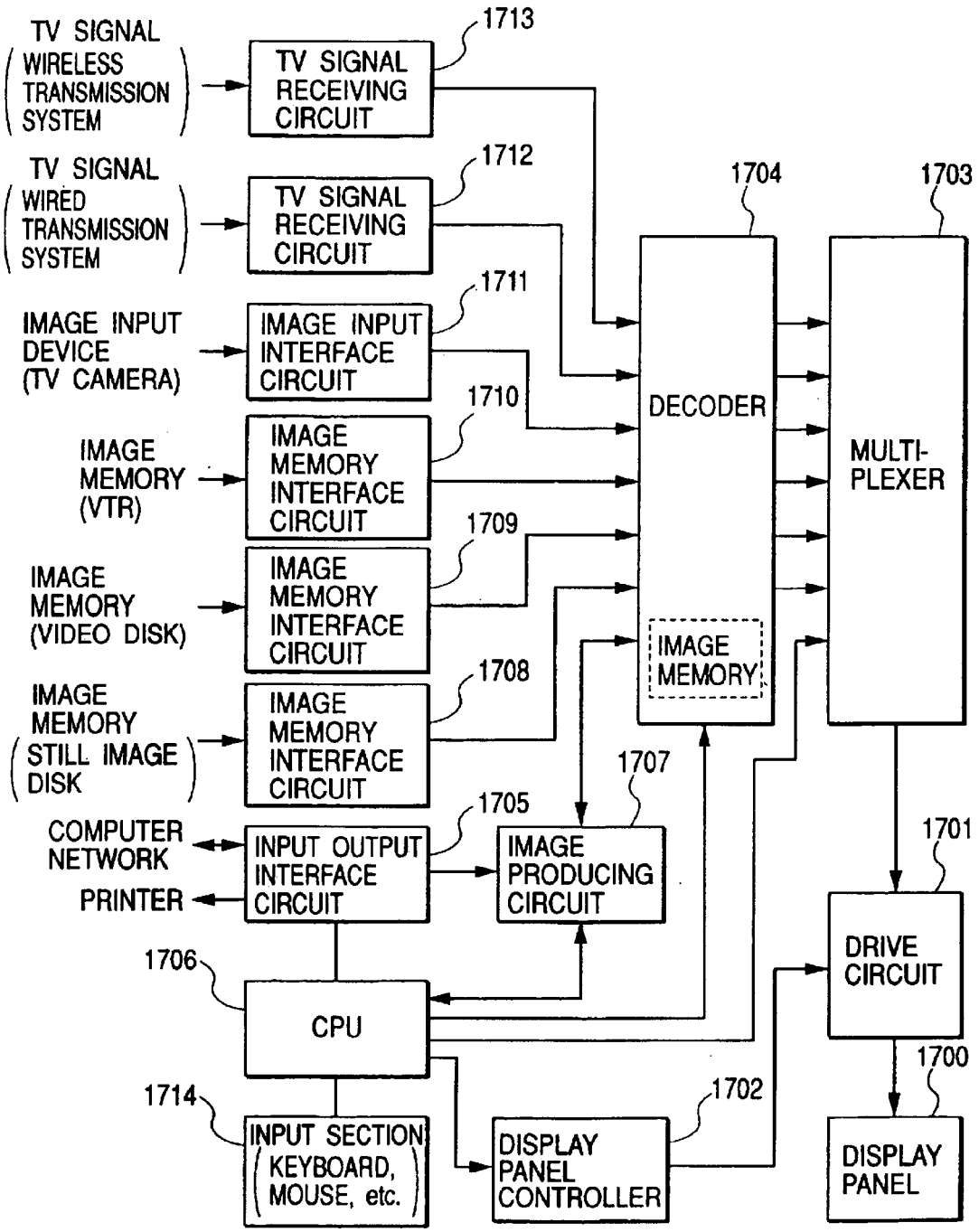
FIG. 17 is a block diagram showing an example of the image forming apparatus of the present invention.

FIG. 17 shows an example of the image forming apparatus of the present invention, so constructed as to display the image information provided from the television broadcasting and other image information sources.

There are shown a display panel 1700, a drive circuit 1701 therefor, a display controller 1703, a multiplexer 1703, a decoder 1704, an I/O interface circuit 1705, a CPU 1706, an image generation circuit 1707, image memory interface circuits 1708 to 1711, TV signal receiving circuits 1712, 1713 and an input unit 1714.

The present image forming apparatus is naturally adapted to reproduce the audio signal simultaneously with the image display in case of receiving a signal including the image information and the audio information as in the case of television signal, but there will not be explained the circuits for the reception, separation, reproduction, processing and storage of the audio information and the epeaker, which are not directly related to the present invention.

In the following there will be explained the functions of various units, according to the flow of the image signal.

At first, the TV signal receiving circuit 1713 receives the TV signal transmitted by a wireless transmission system such as by a wireless wave or by spatial optical transmission. The type of the received TV signal is not particularly limited, and can be, for example, of NTSC, PAL or SECAM type. Also a TV signal utilizing a larger number of scanning lines, such as so-called high-definition television signal including the MUSE system, is a preferred signal source for exploiting the advantages of the above-described display panel adequate for adapted to a large display area or a large number of pixels.

The TV signal received by the TV signal receiving circuit 1713 is supplied to the decoder 1704.

Also the TV signal receiving circuit 1712 receives the TV signal transmitted by a wired transmission system such as a coaxial cable or an optical fiber. As in the case of the TV signal receiving circuit 1713, the type of the received TV signal is not particularly limited, and the TV signal received by the circuit 1712 is also supplied to the decoder 1704.

The image input interface circuit 1711 fetches the image signal supplied from an image input apparatus such as a TV camera or an image scanner, and the fetched image signal is supplied to the decoder 1704.

The image input interface circuit 1710 fetches the image signal stored in a videotape recorder (VTR), and the fetched image signal is supplied to the decoder 1704.

The image input interface circuit 1709 fetches the image signal stored in a video disk, and the fetched image signal is supplied to the decoder 1704.

The image input interface circuit 1708 fetches the image signal from an apparatus storing still image data such as a still image disk, and the fetched image signal is supplied to the decoder 1704.

The I/O interface circuit 1705 connects the present image display apparatus with an external computer, an external network or an output apparatus such as a printer. It can execute input/output of image data and character/graphic information, and also exchange of control signals and numerical data between the CPU 1706 of the present image forming apparatus and the external apparatus.

The image generation circuit 1707 generates display image data, based on the image data and character/graphic information entered from the exterior through the I/O interface circuit 1705 and from the CPU 1706. This circuit is provided therein with a RAM for storing the image data and the character/graphic information, a ROM storing image patterns corresponding to the character codes, a processor for image processing and other circuits required for image generation.

The display image data generated by this circuit are supplied to the decoder 1704, but may also be supplied to the external computer network or the external printer through the I/O interface circuit 1705.

The CPU 1706 principally executes operations for controlling the function of the present image forming apparatus and those relating to the generation, selection and editing of the displayed image.

For example it sends a control signal to the multiplexer 1703, thereby suitably selecting or combining the image signals to be displayed on the display panel. In such operation, it sends a control signal to the display panel controller 1702 according to the image signal to be displayed, thereby suitably controlling the function of the display apparatus such as the image display frequency, scanning method (for example interlaced or non-interlaced) and number of scanning lines in the display image. It also sends the image data and character/graphic information directly to the image generation circuit 1707, or receives image data and character/graphic information by making access to the external computer or the memory through the I/O interface circuit 1705.

The CPU 1706 may also be involved in other operations. For example, it may be directly involved in information generation or processing, such as the function of a personal computer or a word processor. Also it may be connected with an external computer network through the I/O interface circuit 1705 as explained in the foregoing and may execute an operation, such as numerical calculation, in cooperation with the external equipment.

The input unit 1711 is used by the operator to enter a command, a program or data into the CPU 1706, and can be composed of various input devices such as a keyboard, a mouse, a joy stick, a bar code reader or a voice recognition device.

The decoder 1704 is used for inverse conversion of various image signals from the circuits 1707 to 1713 into three primary color signals or into the luminance signal and I, Q signals. The decoder 1704 is preferably provided therein with an image memory, as indicated by a broken line in the drawing, in order to handle the television signal requiring an image memory as in the MUSE system. Also such image memory facilitates the still image display, or image processing and editing such as image skipping, interpolation, enlargement or reduction in cooperation with the image generation circuit 1707 and the CPU 1706.

The multiplexer 1703 suitably selects the displayed image based on the control signal entered from the CPU 1706. More specifically, the multiplexer 1703 selects the desired image signal among the inversely converted image signals entered from the decoder 1704, for supply to the drive circuit 1701. In this operation, it is also possible to display different images in the plural areas divided in an image frame, by switching the image signal within an image frame display time.

The display panel controller 1702 controls the function of the drive circuit 1701 based on control signals supplied from the CPU 1706.

In connection with the basic function of the display panel, the drive circuit 1701 is for example given a signal for controlling the operation sequence of the power source (not shown) for the display panel. Also in connection with the driving method of the display panel, the drive circuit 1701 is given a signal for controlling the image display frequency and the scanning method (for example interlaced or non-interlaced). In certain cases, the drive circuit 1701 may be given control signals for image quality adjustment, such as for luminance, contrast, color and sharpness of the displayed image.

The drive circuit 1701 generates a drive signal to be supplied to the display panel 1700, and functions according to the image signal supplied from the multiplexer 1703 and the control signals supplied from the display panel controller 1702.

In the foregoing there have been explained the functions of various units, and the present image forming apparatus of the configuration shown in FIG. 17 can display, on the display panel 1700, the image information entered from various image information sources. The various image signals, including that of the television broadcasting, are subjected to inverse conversion in the decoder 1704, then suitably selected by the multiplexer 1703 and supplied to the drive circuit 1701. On the other hand, the display controller 1702 generates control signals for controlling the function of the drive circuit 1701 according to the image signal to be displayed. Based on the image signal and the control signals, the drive circuit 1701 supplies the display panel 1700 with drive signals, whereby an image is displayed on the display panel 1700. These operations are collectively controlled by the CPU 1706.

The present image forming apparatus is capable not only of displaying the information selected from the image memory provided in the decoder 1704 and from the image generation circuit 1707, but also of image processing such as enlargement, reduction, rotation, displacement, edge enhancement, image skipping, interpolation, color conversion and change in image aspect ratio and image editing such as synthesis, erasure, connection, replacement and image fitting. There may also be provided an exclusive circuit for processing or editing the audio information, as in the case of image processing or image editing explained above.

Consequently the present image forming apparatus can serve, within a single unit, a display equipment for the television broadcasting, a terminal equipment for the television conference, an image editing equipment for still and moving images, a terminal equipment for the computer, an office terminal equipment such as a word processor and a game equipment, having extremely wide applications in home and industrial use.

FIG. 17 merely shows an example of the configuration of the image forming apparatus employing the display panel in which the electron emission devices are used as the electron beam sources, and the image forming apparatus of the present invention is naturally not limited to such configuration.

For example, among the components shown in FIG. 17, those relating to the unnecessary functions may be dispensed with. Inversely, the components may be further added depending on the purpose of use. For example, in case the present image forming apparatus is used as a television telephone unit, there may be advantageously added transmission/reception circuit including a television camera, a microphone, an illuminating unit and a modem.

The present image forming apparatus can be made compact in the depth dimension, since the electron emission devices employed as the electron sources allows to render the display panel thinner. In addition, the display panel employing the electron emission devices as the electron beam sources can be easily made in a large image size with a high luminance and a wide viewing angle, whereby the image forming apparatus can display an image with real feeling and strong impact with satisfactory visibility.

In the following there will be explained the deposition process preferred for the electron source of the present invention.

In the conventional deposition process for producing the electron source, for example in a matrix arrangement of m rows by n columns with m=1000 and n=2000 and in case of dividing such arrangement into groups each consisting of consecutive 100 rows and applying voltage to such 10 groups in succession, the current required for each group becomes as high as 400 A with a current of 2 mA for each pre-element, so that the generated heat may cause a change in the element characteristics or destruction of the element depending on the material or shape of the substrate.

Also in case forming groups each consisting of consecutive 10 rows and applying voltage to thus formed 100 groups in succession, there will be required a current of 40 A for each group. In such case, the voltage applied to the pre-element, for example with a pulse width of 1 msec, involves a pause time of 99 msec (duty=1/100), whereby the duty ratio is limited and may deteriorate the element characteristics. Also if the voltage is applied simultaneously or in succession to the adjacent rows, the element characteristics may be affected by the heat generation and the consumption of the substance for forming the deposit leading to a change in the partial pressure of such substance in the gaseous atmosphere and the formation of inhibition gas.

The present invention is featured, in executing deposition by simultaneous voltage application in the unit of row-direction wirings plural times in succession, by separating the wirings to be subjected to the simultaneous voltage application by a desired distance and also separating the wiring to be subjected to the successive voltage applications by a desired distance, thereby suppressing the influence of the heat generation, generation of inhibition gas and loss of partial pressure by consumption of the above-mentioned substance. In the following there will be explained embodiments.

FIG. 5 is a schematic view of an electron source substrate, bearing a simple matrix wiring of m rows by n columns, prior to the deposition process. Also FIG. 8 is a timing chart showing voltage applied to the different rows.

The plural pre-elements are connected to the row wirings 502 and the column wirings 503, and each pre-element is given a desired voltage by the application of desired voltages thereto. The number m of the rows can be represented as m=a×b×c, wherein a is the number of row wirings subjected to a simultaneous voltage application and is the number of groups, c is the number of row wirings subjected to successive voltage applications within a group and is the number of row wirings contained in each sub group, and b is the number of times of deposition steps and is the number of sub groups. Thus the groups and sub groups are divided in the unit of the row wiring, and row wirings of a number m are divided into groups of a number a, each consisting of b×c wirings, and each group is divided into sub groups of a number b, each consisting of row wirings of a number c. Within the sub group in each group, the row wirings are subjected to the voltage application in succession. Also the sub groups among different groups are so selected that they are as mutually apart as possible in the selection of the sub groups subjected to the simultaneous or successive voltage application.

Figure 8:
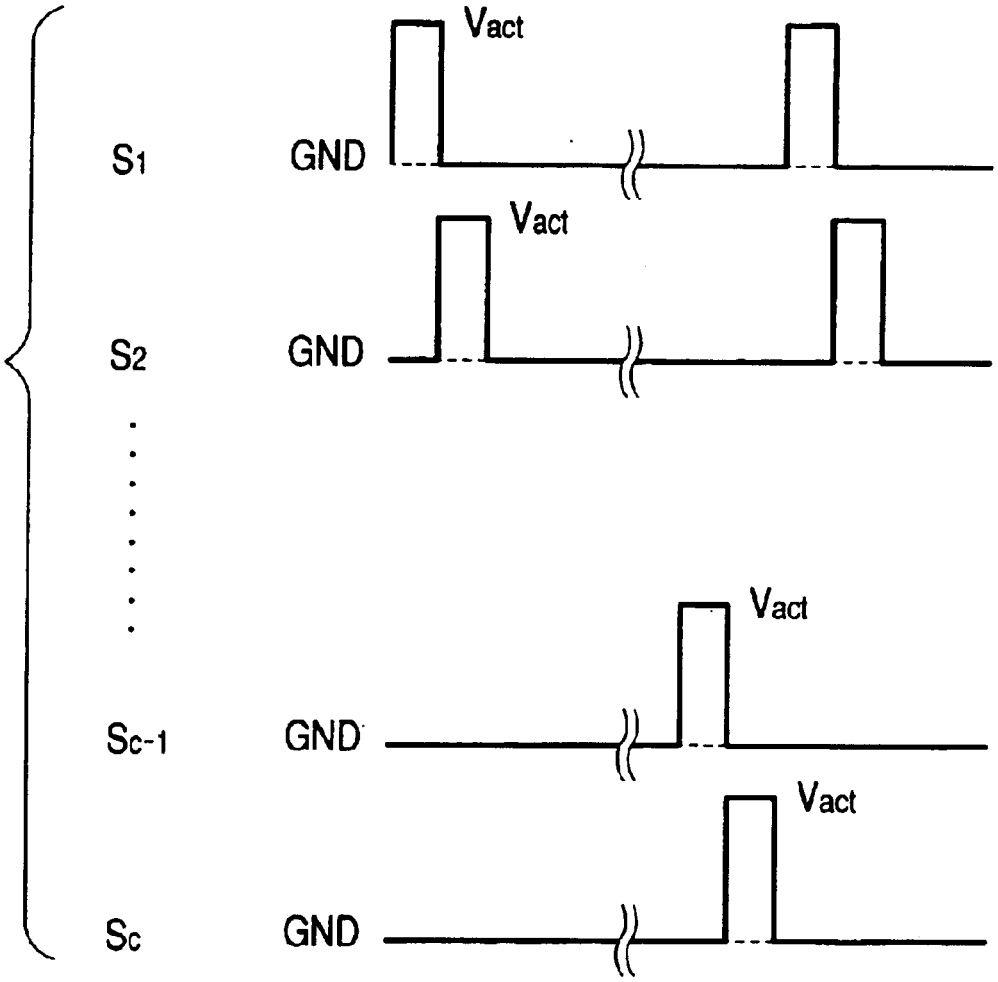
FIG. 8 is a timing chart showing the timing of voltage application in the deposition step in the method of the present invention for producing the electron source.

Referring to FIG. 8, signals $S_1$ to $S_c$ of a number c are given in a scrolling manner.

Figure 1:
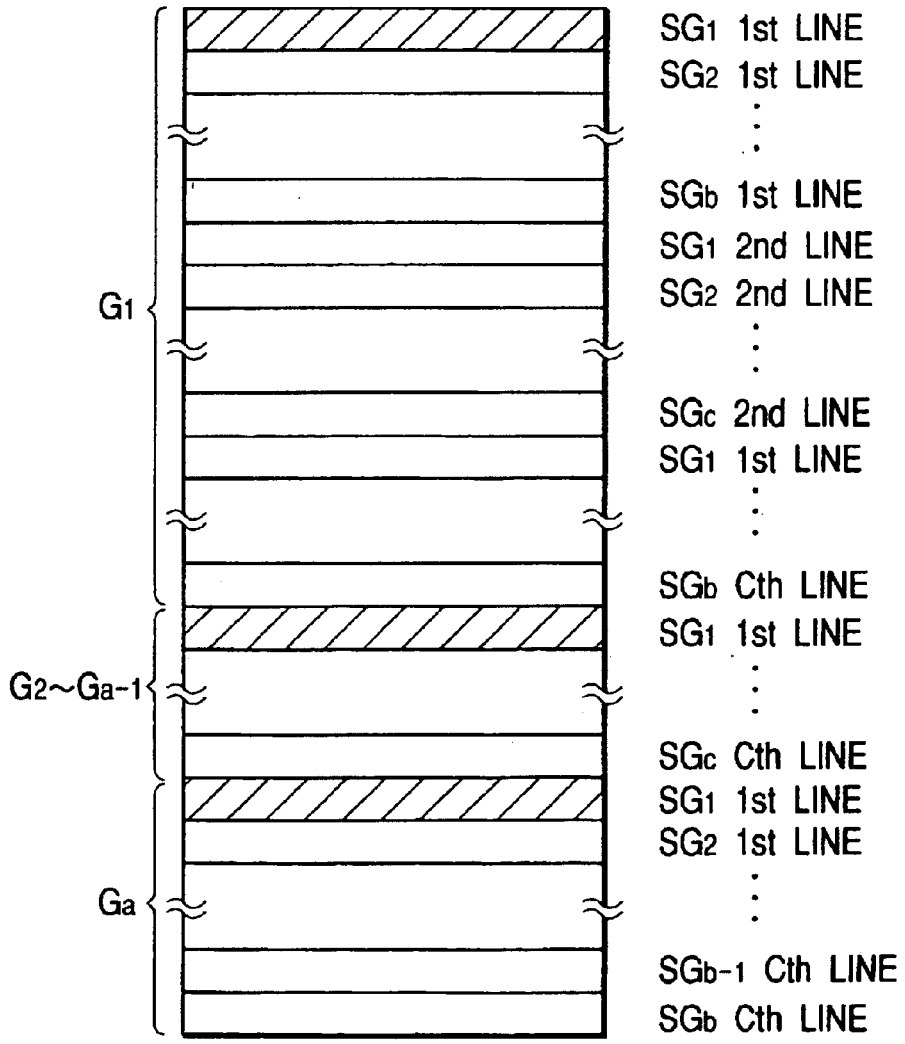
FIG. 1 is a schematic view showing the mode of division of groups and sub groups in an embodiment of the method of the present invention for producing the electron source.
Figure 14:
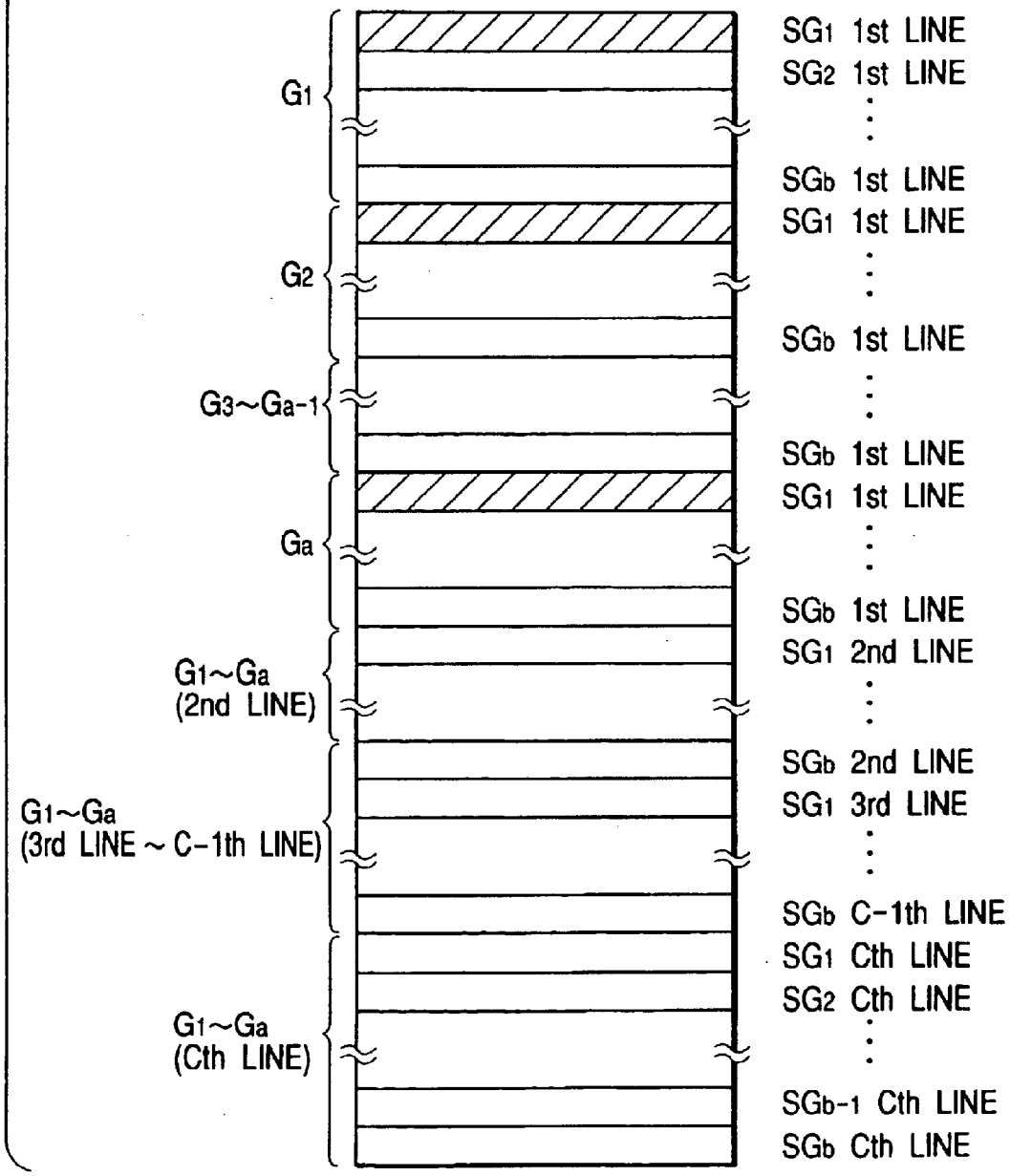
FIG. 14 is a schematic view showing the mode of division of groups and sub groups in another embodiment of the method of the present invention for producing the electron source.
Figure 15:
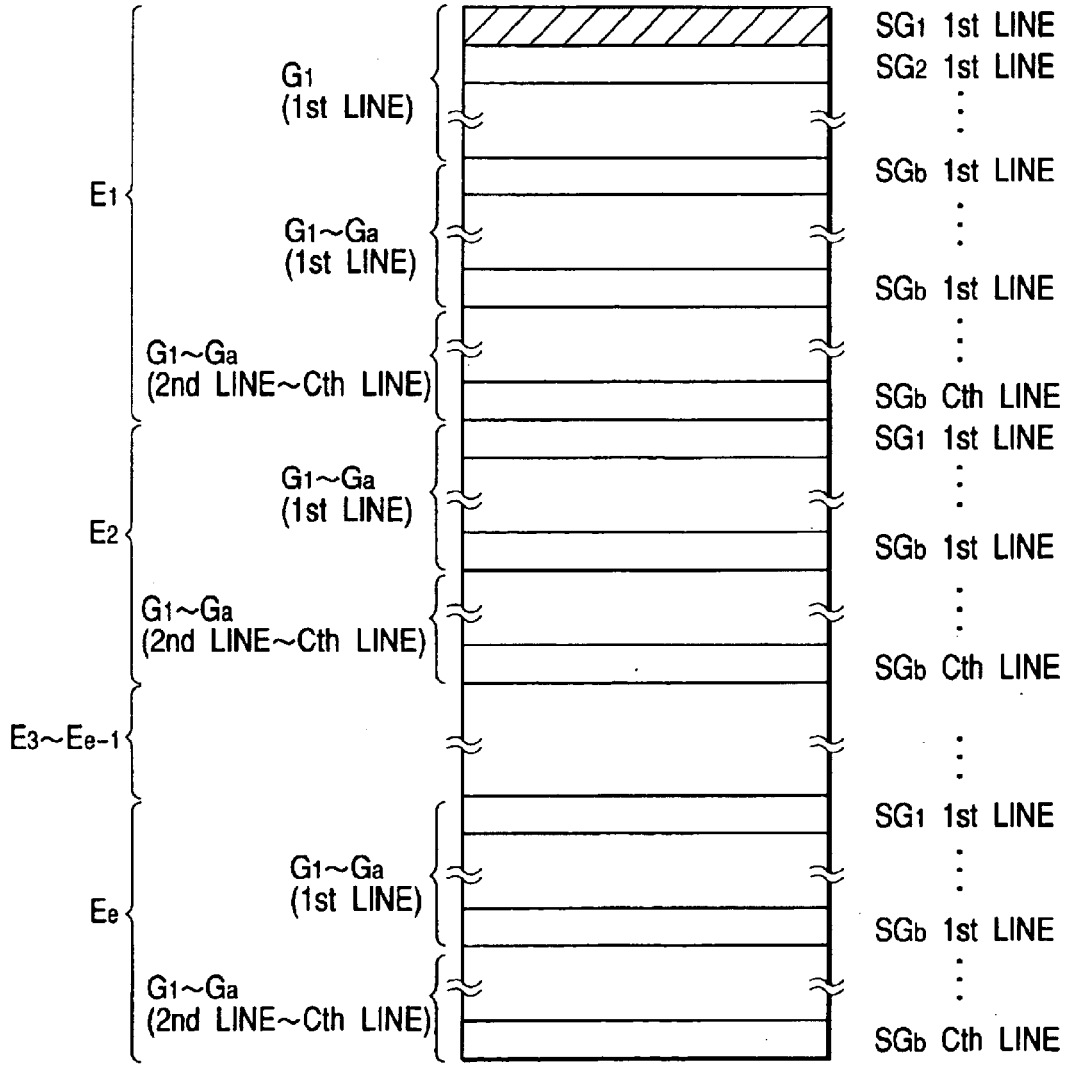
FIG. 15 is a schematic view showing the mode of division of groups and sub groups in an embodiment of the method of the present invention for producing the electron source.
Figure 16:
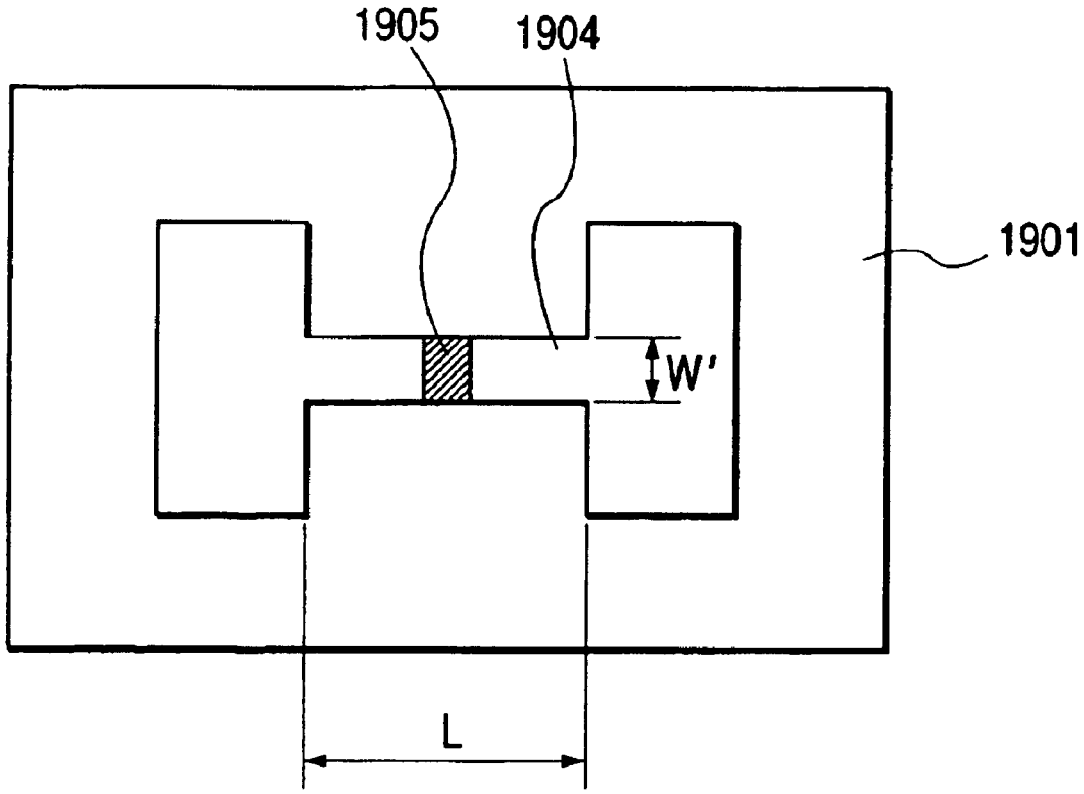
FIG. 16 is a schematic view of a conventional surface conduction electron emission device.

FIGS. 1, 14 and 15 show examples of the wiring numbers respectively belonging to such signals $S_1$ to $S_c$ and of division of the groups and sub groups in the row wirings on the electron source substrate, wherein $D_{yq}$ indicates a q-th row wiring, so that $D_{y(a-1)bc+b+d}$ indicates a ((a−1)×b×c+b+d)th row wiring. Also $G_p$ indicates a p-th group and $SG_r$ indicates an r-th sub group within each group. Also an s-th line indicates an s-th row wiring within each sub group.

FIG. 1 shows a case of separating as far as possible the wirings to be subjected to the simultaneous voltage application and when separating the wirings to be subjected to the successive voltage application, and the groups are positioned in succession with mutually continuous areas. In the configuration shown in FIG. 1, the row wirings of a number m are divided into groups $D_{y1}$ to $D_{ybc}$, $D_{ybc1}$ to $D_{y2bc}$, . . . , $D_{y(a-2)bc+1}$ to $D_{yabc}$ or a number a. Then the group $D_{y1}$ to $D_{ybc}$ is divided into sub groups each consisting of c wirings and mutually spaced by b wirings, whereby the voltage i applied in succession to c wirings separated by b wirings in each group and simultaneously to wirings of a number a, mutually spaced by b×c wirings. Within each group, after the deposition step of a sub group, the deposition step is executed on a next sub group. The sub groups subjected to the voltage application are arranged among different groups as shown in FIG. 1, whereby the wirings are spaced by b×c wirings in the simultaneous voltage application and by b wirings in the successive voltage applications.

More specifically, the voltage is at first applied to the 1st wirings in $SG_1$ of the different groups. Then the voltage is applied in succession to the 2nd and ensuing wirings of the same sub groups, whereby the deposition process is conducted on the $SG_1$ of the different groups. Such deposition process is repeated for each sub groups starting from $SG_2$, by b times in total, whereby all the sub groups are subjected to the deposition process.

FIG. 14 shows a case of separating as far as possible the wirings subjected to the successive voltage applications and then to separate the wirings subjected to the simultaneous voltage application. In this case, x-th wirings in the different sub groups of the different groups are positioned in successive manner in all the sub groups in each group. At first, as in FIG. 1, the row wirings of a number m are divided into groups of a number a, each containing sub groups of a number b, each consisting of c row wirings. Then, for each group, same-numbered rows of the different sub groups are positioned in succession. Thus, as shown in FIG. 14, the 1st lines of the different sub groups with $G_1$, namely 1st lines of $SG_1$, $SG_2$, . . . , $SG_b$ of $G_1$, are positioned in succession, and for other groups starting from $G_2$, the 1st lines of the different sub groups are similarly arranged in the order of the sub groups. Then the similar arrangement is made for the 2nd and ensuing lines. The groups are mutually separated by a pitch of (a−1)×b wirings, and the sub groups are mutually separated by a pitch of a×b wirings.

The deposition process is executed by applying the voltage simultaneously to the 1st lines of the $SG_1$ of the different groups, represented by hatched areas, and then to the 2nd lines of the same sub group. The deposition process for all the elements is completed by repeating this operation b times for different sub groups. Consequently, the wirings subjected to simultaneous voltage application are mutually separated by b wirings and those subjected to successive voltage applications are separated by b to a×b wirings.

FIG. 15 shows a 3rd example in which the row wirings are divided into consecutive e areas, and the deposition as in FIG. 14 is executed for the areas of a×b×c wirings, where in $E_1$ indicates a t-th area (t=1 to e). In this case, there basically exist configurations of FIG. 14 in e units in total. Consequently the deposition process is repeated b×e times, counting the deposition for each sub group as one time.

In the foregoing there have been explained the examples of the deposition process of the present invention, but the present invention is not limited by such examples. The present invention, owing to the specified deposition process, reduces the limitation on the duty ratio, thereby executing the deposition process within a short time while suppressing the influence of the heat generation in this process, generation of inhibition gas and loss of the partial pressure of the substance consumed in deposition within the gaseous atmosphere, thereby avoiding the damage to the substrate or the fluctuation in the element characteristics. As a result, the electron source of the present invention can reduce the distribution in the luminance, thereby providing the image forming apparatus of high quality.

In the foregoing embodiments, the deposition process of the present invention is applied to the surface conduction electron emission device for forming the deposit in the gap of the conductive film constituting the electron emission portion, but the object of application of the present invention is not limited to such embodiments. For example, the present invention is also applicable to the preparation of the electron emission device of spindt type. More specifically, the present invention may be applied to form a deposit on the emitter cone structure and/or the gate electrode of the spindt type electron emission device.

EXAMPLES

In the following there are shown specific examples of the present invention, wherein $G_P$ indicates a p-th group and $SG_r$ indicates an r-th sub group.

Comparative Example

In this example, the deposition process was conducted on a substrate provided with pre-elements in 120 rows by 360 columns in the configuration shown in FIG. 5. More specifically, after the process up to the forming step, the substrate was placed in benzonitrile atmosphere of 1×10–4 Pa. Then 360 column wirings were connected in common to the ground, and a pulsed voltage of a height of 15 V, a width of 1 msec and a frequency of 100 Hz was applied for 30 minutes in succession to the 1st to 10th row wirings. The deposition was executed in the unit of 10 consecutive row wirings, in the order of 11th to 20th wirings and then to the 21st to 30th wirings.

As a result, deposition process required 6 hours in total, with a device current $I_f$ at the end of the deposition process for each wiring was 250 to 350 mA with an average of 286 mA, a standard deviation of 49 mA and standard deviation/average=17%. Then the stabilizing step was executed to obtain the device current $I_f$ of 220 to 310 mA, with an average of 268 mA, a standard deviation of 45 mA and standard deviation/average=16%, and with an emission current $I_n$ of 180 to 350 $\mu$A with an average of 360 $\mu$A, a standard deviation of 58 $\mu$A and standard deviation/average=28%. The measurement was conducted under conditions of a voltage of 14.5 V, a pulse width of 1 msec, a frequency of 10 Hz, an anode distance of 3 mm and an anode voltage of 1 kV.

Example 1

In this example, the deposition process was conducted on a substance provided with pre-elements in 120 rows by 360 columns as in the comparative example. As in the comparative example, after the process up to the forming step, the substrate was placed in benzonitrile atmosphere of $1\times10^{-4}$ Pa. Then 360 column wirings were connected in common to the ground. In the row wirings, the 1st to 30th were groups as $G_1$, the 31st to 60th as $G_2$, the 61st to 90th as $G_e$ and the 91st to 120th as $G_4$. Then each of the groups $G_1$ to $G_4$ was divided into 3 sub groups, each consisting of 10 row wirings. A pulsed voltage of a height of 15 V and a width of 1 msec was applied in succession within each group and simultaneously among different groups.

In this manner 4 row wirings in the simple matrix substrate were subjected to voltage application simultaneously, and 10 wirings in each group were subjected to voltage application in succession, whereby 40 wirings in total were subjected to the deposition process. A deposition process 1 was executed on 40 row wirings, by applying pulsed voltage of a width of 1 msec and a frequency of 100 Hz for 30 minutes.

Then deposition processes 2, 3 were executed on the remaining row wirings to complete the deposition on all the 120 row wirings. Table 1 shows the numbers of rows subjected to the simultaneous and successive voltage applications in these deposition processes.

TABLE 1

| Successive scroll No. | row No. |
|---|---|
| Activation process 1 ($SG_1$) | |
| No. 1 | 1, 31, 61, 91 |
| No. 2 | 4, 34, 64, 94 |
| No. 3 | 7, 37, 67, 97 |
| No. 4 | 10, 40, 70, 100 |
| No. 5 | 13, 43, 73, 103 |
| No. 6 | 16, 46, 76, 106 |
| No. 7 | 19, 49, 79, 109 |
| No. 8 | 22, 52, 82, 112 |
| No. 9 | 25, 55, 85, 115 |
| No. 10 | 28, 58, 88, 118 |
| Activation process 2 ($SG_2$) | |
| No. 1 | 2, 32, 62, 92 |
| No. 2 | 5, 35, 65, 95 |
| No. 3 | 8, 38, 68, 98 |
| No. 4 | 11, 41, 71, 101 |
| No. 5 | 14, 44, 74, 104 |
| No. 6 | 17, 47, 77, 107 |
| No. 7 | 20, 50, 80, 110 |
| No. 8 | 23, 53, 82, 113 |
| No. 9 | 26, 56, 86, 116 |
| No. 10 | 29, 59, 89, 119 |
| Activation process 3 ($SG_3$) | |
| No. 1 | 3, 33, 63, 93 |
| No. 2 | 6, 36, 66, 96 |
| No. 3 | 9, 39, 69, 99 |
| No. 4 | 12, 42, 72, 102 |
| No. 5 | 15, 45, 75, 105 |
| No. 6 | 18, 48, 78, 108 |
| No. 7 | 21, 51, 81, 111 |
| No. 8 | 24, 54, 84, 114 |
| No. 9 | 27, 57, 87, 117 |
| No. 10 | 30, 60, 90, 120 |

Thus the deposition process could be completed in 1.5 hours, corresponding to ¼ of the time required in the comparative example. The device current $I_f$ at the end of the deposition process for each wiring was 290 to 340 mA with an average of 318 mA, a standard deviation of 32 mA and standard deviation/average=10%. Then the stabilizing step was executed to obtain the device current $I_f$ of 280 to 310 mA, with an average of 297 mA, a standard deviation of 27 mA and standard deviation/average=9%, and with an emission current $I_e$ of 290 to 350 $\mu$A with an average of 325 $\mu$A, a standard deviation of 34 $\mu$A and standard deviation/average=10%.

The measurement was conducted under conditions of a voltage of 14.5 V, a pulse width of 1 msec, a frequency of 10 Hz, an anode distance of 3 mm and an anode voltage of 1 kV.

As explained in the foregoing, in comparison with the comparative example, the example 1 reduced the fluctuation in the unit of the row wiring and showed an increased average of the emission current $I_e$.

Example 2

In this example, there was employed a substrate provided with pre-elements in 120 rows by 360 columns as in the comparative example. As in the comparative example, after the process up to the forming step, the substrate was placed in benzonitrile atmosphere of $1\times10^{-4}$ Pa. Then 360 column wirings were connected in common to the ground. The row wirings were divided, as shown in Table 2, into four groups $G_1$ to $G_4$ in which three row wirings were positioned in succession and three successive row wirings were positioned at a pitch of 9 wirings. Each of the groups $G_1$ to $G_4$ was divided into 3 sub groups $SG_1$ to $SG_3$, each consisting of 10 row wirings. A pulsed voltage of a height of 15 V and a width of 1 msec was applied in succession within each group and simultaneously among different groups.

In this manner 4 row wirings in the simple matrix substrate were subjected to voltage application simultaneously, and 10 wirings in each group were subjected to voltage application in succession, whereby 40 wirings in total were subjected to the deposition process. A deposition process 1 was executed on 40 row wirings, by applying pulsed voltage of a width of 1 msec and a frequency of 100 Hz for 30 minutes. Then deposition processes 2, 3 were similarly executed on the remaining row wirings to complete the deposition on all the 120 row wirings. Table 3 shows the numbers of rows subjected to the simultaneous and successive voltage applications in these deposition processes.

TABLE 2

| $G_1$ | | | $G_2$ | | | $G_3$ | | | $G_4$ | | |
|---|---|---|---|---|---|---|---|---|---|---|---|
| $SG_1$ | $SG_2$ | $SG_3$ | $SG_1$ | $SG_2$ | $SG_3$ | $SG_1$ | $SG_2$ | $SG_3$ | $SG_1$ | $SG_2$ | $SG_3$ |
| 1 | 2 | 3 | 4 | 5 | 6 | 7 | 8 | 9 | 10 | 11 | 12 |
| 13 | 14 | 15 | 16 | 17 | 18 | 19 | 20 | 21 | 22 | 23 | 24 |
| 25 | 26 | 27 | 28 | 29 | 30 | 31 | 32 | 33 | 34 | 35 | 36 |
| 37 | 38 | 39 | 40 | 41 | 42 | 43 | 44 | 45 | 46 | 47 | 48 |
| 49 | 50 | 51 | 52 | 53 | 54 | 55 | 56 | 57 | 58 | 59 | 60 |
| 61 | 62 | 63 | 64 | 65 | 66 | 67 | 68 | 69 | 70 | 71 | 72 |
| 73 | 74 | 75 | 76 | 77 | 78 | 79 | 80 | 81 | 82 | 83 | 84 |
| 85 | 86 | 87 | 88 | 89 | 90 | 91 | 92 | 93 | 94 | 95 | 96 |
| 97 | 98 | 99 | 100 | 101 | 102 | 103 | 104 | 105 | 106 | 107 | 108 |
| 109 | 110 | 111 | 112 | 113 | 114 | 115 | 116 | 117 | 118 | 119 | 120 |

TABLE 3

| Successive scroll No. | row No. |
|---|---|
| Activation process 1 ($SG_1$) | |
| No. 1 | 1, 4, 7, 10 |
| No. 2 | 13, 16, 19, 22 |
| No. 3 | 25, 28, 31, 34 |
| No. 4 | 37, 40, 43, 46 |
| No. 5 | 49, 52, 55, 58 |
| No. 6 | 61, 64, 67, 70 |
| No. 7 | 73, 76, 79, 82 |
| No. 8 | 85, 89, 91, 94 |
| No. 9 | 97, 100, 103, 106 |
| No. 10 | 109, 112, 115, 118 |
| Activation process 2 ($SG_2$) | |
| No. 1 | 2, 5, 7, 11 |
| No. 2 | 14, 17, 20, 23 |
| No. 3 | 26, 29, 32, 35 |
| No. 4 | 38, 41, 44, 47 |
| No. 5 | 50, 53, 56, 59 |
| No. 6 | 62, 65, 68, 71 |
| No. 7 | 74, 77, 80, 83 |
| No. 8 | 86, 89, 92, 95 |
| No. 9 | 98, 101, 104, 107 |
| No. 10 | 110, 113, 116, 119 |
| Activation process 3 ($SG_3$) | |
| No. 1 | 3, 6, 8, 12 |
| No. 2 | 15, 18, 21, 24 |
| No. 3 | 27, 30, 33, 36 |
| No. 4 | 39, 42, 45, 48 |
| No. 5 | 51, 54, 57, 60 |
| No. 6 | 63, 66, 69, 72 |
| No. 7 | 75, 78, 81, 84 |
| No. 8 | 87, 90, 93, 96 |
| No. 9 | 99, 102, 105, 108 |
| No. 10 | 11, 114, 117, 120 |

Thus the deposition process could be completed in 1.5 hours, corresponding to ¼ of the time required in the comparative example. The device current $I_f$ at the end of the deposition process for each wiring was 270 to 340 mA with an average of 310 mA, a standard deviation of 33 mA and standard deviation/average=11%. Then the stabilizing step was executed to obtain the device current $I_f$ of 260 to 310 mA, with an average of 283 mA, a standard deviation of 31 mA and standard deviation/average=11%, and with an emission current $I_e$ of 260 to 350 $\mu$A with an average of 315 $\mu$A, a standard deviation of 36 $\mu$A and standard deviation/average=11 *.

The measurement was conducted under conditions of a voltage of 14.5 V, a pulse width of 1 msec, a frequency of 10 Hz, an anode distance of 3 mm and an anode voltage of 1 kV.

As explained in the foregoing, in comparison with the comparative example, the example 2 reduced the fluctuation in the unit of the row wiring and showed an increased average of the emission current $I_e$.

Example 3

In this example, there was employed a substrate provided with pre-elements in 120 rows by 360 columns as in the comparative example. As in the comparative example, after the process up to the forming step, the substrate was placed in benzonitrile atmosphere of $1\times10^{-4}$ Pa. Then 360 column wirings were connected in common to the ground. The row wirings were divided, as shown in Table 4, into three groups $G_1$ to $G_3$ in which two row wirings were positioned in succession and two successive row wirings were positioned at a pitch of 5 wirings. Each of the groups $G_1$ to $G_3$ was divided into 4 sub groups $SG_1$ to $SG_4$, each consisting of 40 row wirings. A pulsed voltage of a height of 15 V and a width of 1 msec was applied in succession within each group and simultaneously among different groups.

In this manner 3 row wirings in the simple matrix substrate were subjected to voltage application simultaneously, and 10 wirings in each group were subjected to voltage application in succession, whereby 30 wirings in total were subjected to the deposition process. A deposition process 1 was executed on 30 row wirings, by applying pulsed voltage of a width of 1 msec and a frequency of 100 Hz for 30 minutes. Then deposition processes 2, 3, 4 were similarly executed on the remaining row wirings to complete the deposition on all the 120 row wirings. Table 5 shows the numbers of rows subjected to the simultaneous and successive voltage applications in these deposition processes.

TABLE 4

| $G_1$ | | | | $G_2$ | | | | $G_3$ | | | |
|---|---|---|---|---|---|---|---|---|---|---|---|
| $SG_1$ | $SG_2$ | $SG_3$ | $SG_4$ | $SG_1$ | $SG_2$ | $SG_3$ | $SG_4$ | $SG_1$ | $SG_2$ | $SG_3$ | $SG_4$ |
| 1 | 2 | 61 | 62 | 3 | 4 | 63 | 64 | 5 | 6 | 65 | 66 |
| 7 | 8 | 67 | 68 | 9 | 10 | 69 | 70 | 11 | 12 | 71 | 72 |
| 13 | 14 | 73 | 74 | 15 | 16 | 75 | 76 | 17 | 18 | 77 | 78 |
| 19 | 20 | 79 | 80 | 21 | 22 | 81 | 82 | 23 | 24 | 83 | 84 |
| 25 | 26 | 85 | 86 | 27 | 28 | 87 | 88 | 29 | 30 | 89 | 90 |
| 31 | 32 | 91 | 92 | 33 | 34 | 93 | 94 | 35 | 36 | 95 | 96 |
| 37 | 38 | 97 | 98 | 39 | 40 | 99 | 100 | 41 | 42 | 101 | 102 |
| 43 | 44 | 103 | 104 | 45 | 46 | 105 | 106 | 47 | 48 | 107 | 108 |
| 49 | 50 | 109 | 110 | 51 | 52 | 111 | 112 | 53 | 54 | 113 | 114 |
| 55 | 56 | 115 | 116 | 57 | 58 | 117 | 118 | 59 | 60 | 119 | 120 |

TABLE 5

| Successive scroll No. | row No. |
|---|---|
| Activation process 1 ($SG_1$) | |
| No. 1 | 1, 3, 5 |
| No. 2 | 7, 9, 11 |
| No. 3 | 13, 15, 17 |
| No. 4 | 19, 21, 23 |
| No. 5 | 25, 27, 29 |
| No. 6 | 31, 33, 35 |
| No. 7 | 37, 39, 41 |
| No. 8 | 43, 45, 47 |
| No. 9 | 49, 51, 53 |
| No. 10 | 55, 57, 59 |
| Activation process 2 ($SG_2$) | |
| No. 1 | 2, 4, 6 |
| No. 2 | 8, 10, 12 |
| No. 3 | 14, 16, 18 |
| No. 4 | 20, 22, 24 |
| No. 5 | 26, 28, 30 |
| No. 6 | 32, 34, 36 |
| No. 7 | 38, 40, 42 |
| No. 8 | 44, 46, 48 |
| No. 9 | 50, 52, 54 |
| No. 10 | 56, 58, 60 |
| Activation process 3 ($SG_3$) | |
| No. 1 | 61, 63, 65 |
| No. 2 | 67, 69, 71 |
| No. 3 | 73, 75, 77 |
| No. 4 | 79, 81, 83 |
| No. 5 | 85, 87, 89 |
| No. 6 | 91, 93, 95 |
| No. 7 | 97, 99, 101 |
| No. 8 | 103, 105, 107 |
| No. 9 | 109, 111, 113 |
| No. 10 | 115, 117, 119 |
| Activation process 4 ($SG_4$) | |
| No. 1 | 62, 64, 66 |
| No. 2 | 68, 70, 72 |
| No. 3 | 74, 76, 78 |
| No. 4 | 80, 82, 84 |
| No. 5 | 86, 88, 90 |
| No. 6 | 92, 94, 96 |
| No. 7 | 98, 100, 102 |
| No. 8 | 104, 106, 108 |
| No. 9 | 110, 112, 114 |
| No. 10 | 116, 118, 120 |

Thus the deposition process could be completed in 2 hours, corresponding to ⅓ of the time required in the comparative example. The device current $I_f$ at the 273 end of the deposition process for each wiring was 260 of to 310 mA with an average of 280 mA, a standard deviation of 26 mA and standard deviation/average=9%. Then the stabilizing step was executed to obtain the device current $I_f$ of 250 to 310 mA, with an average of 273 mA, a standard deviation of 26 mA and standard deviation/average=10%, and with an emission current $I_e$ of 270 to 330 $\mu$A with an average of 302 $\mu$A, a standard deviation of 36 $\mu$A and standard deviation/average=12%.

The measurement was conducted under conditions of a voltage of 14.5 V, a pulse width of 1 msec, a frequency of 10 Hz, an anode distance of 3 mm and an anode voltage of 1 kV.

As explained in the foregoing, in comparison with the comparative example, the example 3 reduced the fluctuation in the unit of the row wiring and showed an increased average of the emission current $I_e$.

As explained in the foregoing, the present invention can efficiently provide satisfactory electron source and image forming apparatus.

What is claimed is:

1. A method for producing an electron source comprised of plural electron emission devices, each of which has a gap and is provided with a deposit containing carbon at the gap, said plural electron emission devices connected in a matrix by plural row wirings and plural column wirings, the method comprising:

a connecting step of connecting plural pre-elements that are precursors to the plural electron emission devices, to said plural row wirings, respectively; and a voltage applying step comprising plural sub-steps, each of which includes selecting simultaneously certain plural row wirings including plural row wirings that are not adjacent to each other and applying a voltage to the certain plural row wirings selected simultaneously, within an atmosphere containing an organic gas, wherein the sub-steps are conducted successively so that, in each sub-step, the row wirings to which the voltage is applied simultaneously include plural row wirings each of which is adjacent to row wirings to which the voltage was not applied in an immediately prior one of the sub-steps and therefore is not immediately sandwiched by row wirings to which the voltage was applied in the immediately prior one of the sub-steps, wherein at least one deposit is deposited as a result of the voltage applying step.

2. A method for producing an image forming apparatus which comprises producing an electron source by the method according to claim 1 and combining thereto an image forming member for forming an image by irradiation with an electron beam from said electron source.

3. A method for producing an electron source comprised of plural electron emission devices, each of which is provided with a deposit, said plural electron emission devices connected in a matrix by plural row wirings and plural column wirings, the method comprising:

a providing step of providing plural pre-elements that are percursors to the plural electron emission devices, wherein each of the plural pre-elements is connected to each of said plural row wirings; and a depositing step of depositing the deposit, the depositing step comprising at least three sub-steps, each including applying a voltage to at least one respective row wiring to deposit the deposit to at least one pre-element connected to the at least one respective row wiring, within an atmosphere containing an ingredient for the deposit, the at least three sub-steps being conducted successively so that, in each of the at least three sub-steps, the at least one respective row wiring to which the voltage is applied is adjacent to a row wiring to which the voltage was not applied in an immediately prior one of the sub-steps and therefore is not immediately sandwiched by row wirings to which the voltage was applied in the immediately prior one of the sub-steps.

4. The method according to claim 3, wherein the voltage is applied to plural row wirings in each of the plural sub-steps.

5. The method according to claim 4, wherein the plural row wirings to which the voltage is applied in each of the plural sub-steps are not adjacent each other.

6. The method according to claim 3, wherein the deposit contains at least carbon.

7. The method according to claim 3, wherein a differential voltage between the voltage for depositing the deposit and a voltage which is applied to at least one column wiring is applied to the at least one pre-element, whereby the deposit is deposited to the at least one pre-element by the differential voltage.

* * * * *

UNITED STATES PATENT AND TRADEMARK OFFICE

CERTIFICATE OF CORRECTION

PATENT NO. : 6,878,027 B1
APPLICATION NO. : 09/512360
DATED : April 12, 2005
INVENTOR(S) : Hideshi Kawasaki It is certified that error appears in the above-identified patent and that said Letters Patent is hereby corrected as shown below:

ON TITLE PAGE [56] REFERENCES CITED

Foreign Patent Documents, "JP 0 660 357 A1 6/1995" should read --EP 0 660 357 A1 6/1995--.

COLUMN 9

Line 52, "manner," should read --manners,--.

COLUMN 13

Line 63, "$T_{SCAN}$," should read --$T_{scan}$,--.

COLUMN 19

Line 56, "$D_{y(a-2)bc+1}$" should read --$D_{y(a-1)bc+1}$--.

COLUMN 21

Line 8, "1x10-4" should read --$1x10^{-4}$--; and
Line 27, "In" should read --Ie--.

COLUMN 23

Line 65, "No. 10 11," should read --No. 10 111,--.

UNITED STATES PATENT AND TRADEMARK OFFICE

CERTIFICATE OF CORRECTION

PATENT NO. : 6,878,027 B1
APPLICATION NO. : 09/512360
DATED : April 12, 2005
INVENTOR(S) : Hideshi Kawasaki It is certified that error appears in the above-identified patent and that said Letters Patent is hereby corrected as shown below:

COLUMN 24

Line 11, "11*." should read --11%.--.

Signed and Sealed this

Thirty-first Day of October, 2006

JON W. DUDAS
*Director of the United States Patent and Trademark Office*